US005800048A

United States Patent [19]

Gordin

[11] Patent Number: 5,800,048

[45] Date of Patent: Sep. 1, 1998

[54] SPLIT REFLECTOR LIGHTING FIXTURE

[75] Inventor: Myron K. Gordin, Oskaloosa, Iowa

[73] Assignee: Musco Corporation, Oskaloosa, Iowa

[21] Appl. No.: 616,056

[22] Filed: Mar. 14, 1996

[51] Int. Cl.[6] ..... F21V 21/28

[52] U.S. Cl. ..... 362/275; 362/283; 362/287; 362/289; 362/297; 362/346

[58] Field of Search ..... 362/275, 287, 362/289, 297, 346, 283

[56] References Cited

U.S. PATENT DOCUMENTS

| | | | |
|---|---|---|---|
| 2,217,790 | 10/1940 | Boynton | 362/289 |
| 2,311,734 | 2/1943 | Clarkson | 362/289 |
| 4,075,470 | 2/1978 | Moore | 362/287 |
| 4,419,721 | 12/1983 | Gregoire et al. | 362/287 |
| 5,047,908 | 9/1991 | Dixon et al. | 362/346 |

*Primary Examiner*—Carroll B. Dority
*Attorney, Agent, or Firm*—Zarley, McKee, Thomte, Voorhees, & Sease

[57] ABSTRACT

A lighting fixture for control of a concentrated high intensity light beam to a relatively distant target location. A reflector end high intensity light source are enclosed within a housing. The light source is moveable with respect to the reflector. The reflector has first and second portions which are moveable with respect to each other. The movement between portions of the reflector and the movement of the light source relative to the reflector allow a variety of different beam configurations and orientations from the fixture.

19 Claims, 19 Drawing Sheets

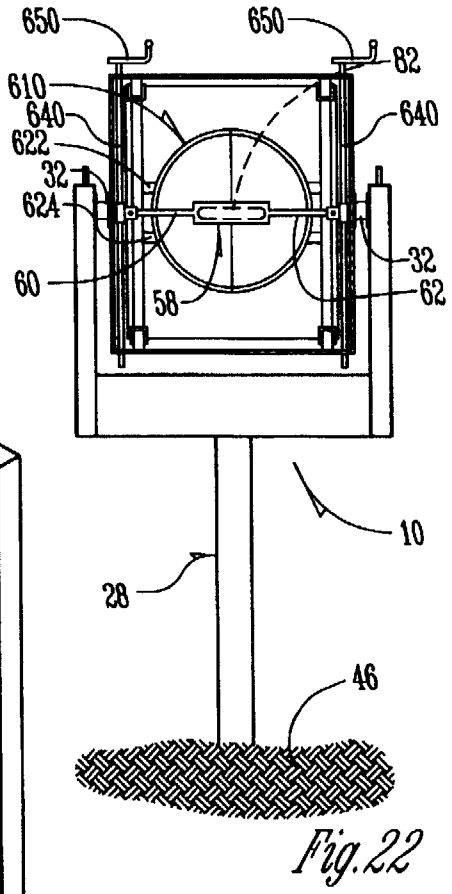
Fig.22
Fig.21
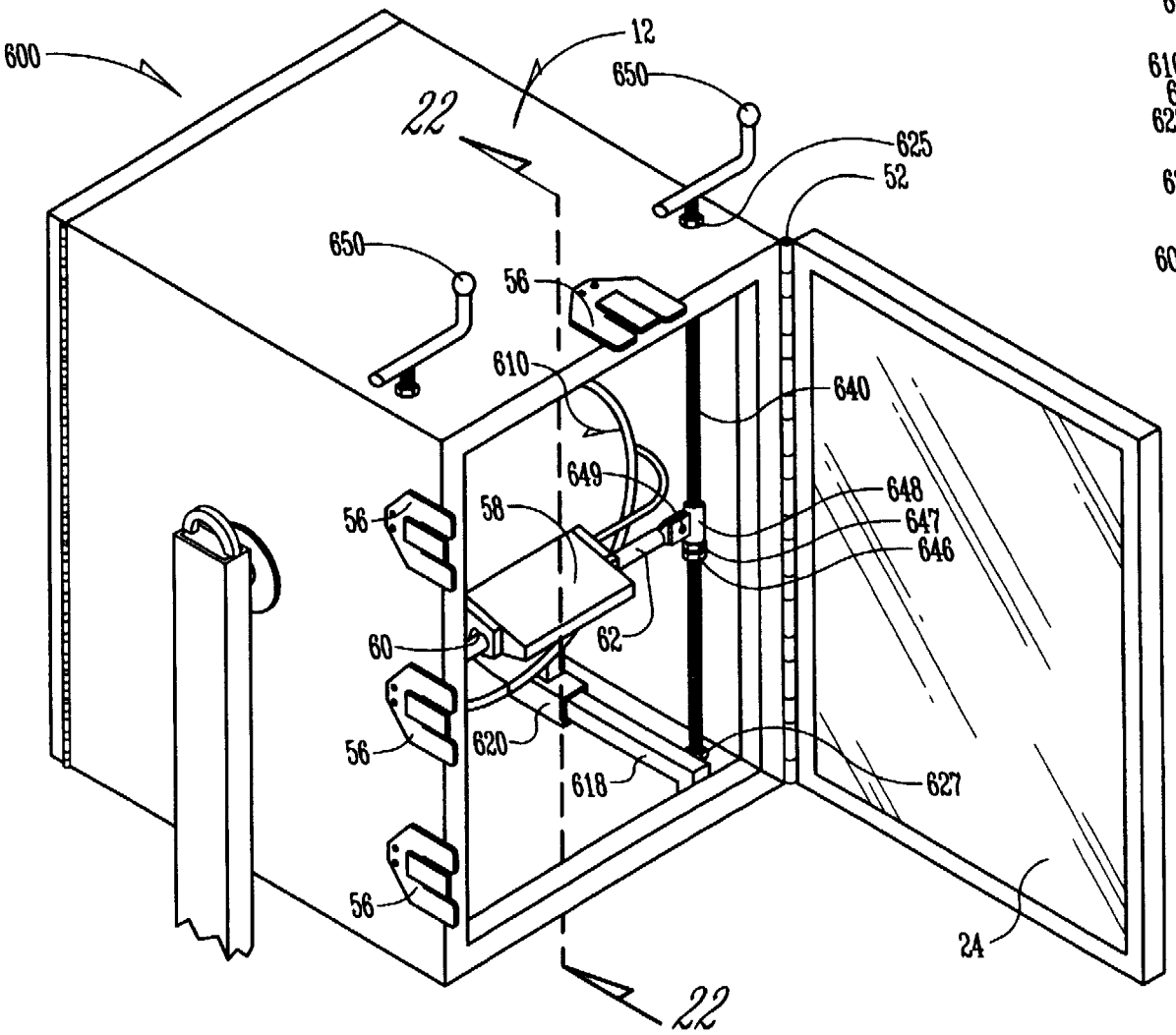

SPLIT REFLECTOR LIGHTING FIXTURE

BACKGROUND OF THE INVENTION

A. Field of the Invention

The present invention relates to lighting fixtures, and in particular, to lighting fixtures which utilize a high intensity discharge light source for the purposes of creating a controlled concentrated beam to a substantially distant target location.

B. Problems in the Art

There continues to be a need for improvement regarding lighting of large target areas. Not only is the efficiency of the lighting a primary consideration, but also the economy of the fixture itself is significant. It would also be valuable if the fixture had the flexibility of allowing adjustment of the beam size, shape, and orientation without replacement of parts or significant work to or modification of the fixture itself.

Some examples will assist in an understanding of these considerations. Major automobile race tracks, such as NASCAR™ tracks occupy a large area. The tracks are generally oval in shape, sometimes a mile or longer in length and tens of yards wide. Another large area lighting target would be athletic fields such as football, baseball, and soccer fields. Many other similar examples exist.

Years ago, incandescent light sources were the light source of choice for large target areas. The light output from each incandescent lamp, however, was small compared to present high intensity discharge (HID) light sources. Therefore, while incandescent lights were relatively cheap individually to run (the cost of electricity), many lights were required for each lighting job to create the needed lighting throughout the target area. Huge banks of incandescent fixtures were therefore utilized. The relatively cheap operation of each incandescent lamp was therefore offset by the large number of fixtures needed. Additionally, many times such fixtures were elevated in the air to create lighting both to the target area and over the volume of space above the target area, particularly in athletic fields where the players and spectators needed to see the travel of a ball, that can sometimes travel far above the playing surface. Lights were also elevated to attempt to reduce glare into the spectators and players eyes, as well as to leave ground space for the playing area, bleachers, etc.

HID lamps came into wide spread use in the 1970's. Higher wattage HID lamp could put out significantly more light than any incandescent lamp. They also could last a substantial length of time before needing replacement and were fairly efficient with respect to the amount of electricity used relative to the amount of light output. Substantial effort went into developing reflectors that would compliment the HID light sources to generate high efficiency use of the high intensity light.

While many forms and types of reflectors have been used over the years, the symmetrical bowl shaped reflector, usually a rotated parabola, ellipse, or spherical shape, or combinations thereof, represented a good compromise between size, control of light, and cost of manufacturing. Such reflectors could be spun or hydro-formed quickly and relatively inexpensively compared to more complex and costly other types of reflectors.

Today one easily comes into contact with spherical or bowl shaped reflectors utilizing HID lamps for any number of applications. They are particularly useful where controlled concentrated beams are required over substantial distances. Therefore athletic fields, race tracks and similar applications utilize such fixture types. The combination of the bowl shaped reflector and HID lamp allowed for lighting of sports fields, for example, with a substantially reduced number of fixtures. Thus, the number of poles, a big part of the expense for lighting projects for athletic fields, as well as the number of lamps, reflectors and associated hardware is significantly reduced. Wind load is also reduced by reducing the number of fixtures.

Co-invented and co-owned U.S. Pat. Nos. 4,725,934, 4,947,303, 5,016,150, and 5,075,828, incorporated by reference herein, illustrate bowl shaped reflectors and HID sources. Those patents also illustrate that additional room for improvement existed in some respects with regard to HID lights and bowl shaped reflectors. Because the reflectors are symmetrical, light did not necessarily always travel to desired locations. As explained in those applications, there was therefore a need for improvement with regard to control and direction of these high intensity light beams.

Co-pending and co-owned U.S. patent application Ser. No. 07/820,486, filed Jan. 14, 1992 and entitled "Highly Controllable Lighting", incorporated by reference herein, discloses a new concept for lighting of these types of areas. A light source was actually directed away from the target area by a primary reflector into what is called a secondary reflector. The secondary reflector controlled and directed light energy from the light source and a controlled concentrated beam to the target area. As set forth in the above-mentioned patent application, such fixtures were specially useful in lighting such things as race car tracks because they could be placed directly on the ground on the infield side of the track. The extreme control of the high intensity light was such that vertical cut-off of the light beams could be controlled within inches so that spectators would not experience glare from the fixtures. The direction of the beams and shape of the beams could also be controlled to avoid significant glare in the drivers' eyes. Light could also be spread evenly around the whole length of the track. Thus, a level of light sufficient for such things as televising race track events, which requires a significant level of light and a uniform level of light, became possible without the hundreds of light poles and several light fixtures per pole that would be needed if attempted to be lit by the more conventional bowl shaped reflectors elevated on poles. Such elevated configurations also would block views of the track and create a picket fence effect for viewers watching the high speed cars.

Co-owned and co-pending U.S. patent application Ser. No. 08/375,650, filed Jan. 20, 1995, entitled "High Efficiency, Highly Controllable Lighting Apparatus and Method", also incorporated by reference herein, goes a step beyond the previously mentioned patent application. Instead of having a separate primary reflector and light source that directs light to a secondary reflector spaced apart therefrom, the more recent patent application discloses a self contained lighting fixture which utilizes a housing of only several feet in height, width, and depth. Inside is a high intensity light source that has a small primary reflector placed directly beside it and a plurality of reflector or mirror segments spaced from the light source and aligned along a parabolic curve. Each segment can be adjusted in angular orientation to the light source. Thus, each fixture can output a very efficient, highly controlled concentrated light beam. Utilization of these fixtures reduces the size and number of fixtures over that of the previously described patent applications Therefore efficiencies and cost, as well as the amount of occupied space can for light fixtures be achieved. Furthermore, the working components of fixtures of the type just described are less susceptible to the outside environment. Such fixtures are also more easily utilized either on the ground or in elevated positions. Importantly, enclosure of the working elements of the fixture allows for fine pre-adjustment or re-adjustment of the mirror segments without significant risk of those segments going out of alignment very easily.

While improvement has been achieved by fixtures described in the two patent applications, there is still a need for improvement at least in the following respects.

There is need for more control in all directions of the light beam emanating from the fixture. The last-described patent application has a high degree of control of light at the beam's upper and lower margins, but room for improvement exists with regard to the beam's side margins.

There is also a need for improvement with respect to the ability to easily and quickly adjust such things as beam size, shape, and orientation. Adjustment of the mirror segments of the last described patent application can be time consuming and cumbersome.

Also, there is a continued need for improvement with regard to the efficiency and economy of light fixtures. Utilization of the segments of the last described patent application fixture involves significant complexity of structure.

It is therefor the principle object of the present invention to provide a lighting fixture which improves upon the state of the art.

Another object of the present invention is to provide a lighting fixture which is non-complex in structure yet provides a controlled, concentrated high intensity light beam for use to a distant target location.

Another object of the present invention is to provide a light fixture which utilizes a bowl shaped reflector and high intensity discharge light source but allows alteration of the shape of the reflector and the location of the light source relative to the reflector to easily change size, shape, and orientation of the light beam.

Another object of the present invention is to allow relatively easy adjustment of size, shape, and orientation of the light beam without changing parts or altering the fixture.

These and other objects, features, and advantages of the present invention will become more apparent with reference to the accompanying specification and claims.

SUMMARY OF THE INVENTION

The present invention comprises a means and method of producing a controlled, concentrated high intensity light beam from a self contained fixture. A reflecting surface has first and second portions movable with respect to one another. A high intensity light source is movably positionable relative to the reflecting surface. Movement of the light source and/or movement of the first and second portions of the reflecting surface cause changes in the light beam characteristics emanating from the lighting fixture, for example, changes in the size, shape, or orientation of the beam.

An optional feature of the invention is the utilization of a primary reflector of a size relatively the same as the size of the light source, positioned near or at the light source. The reflecting surface then comprises a secondary reflector. Light energy directly from the light source, and as reflected from the primary reflector, travel to the secondary reflector or reflecting surface. Therefore, a high degree of efficiency related to the capture and control of the light source is achieved.

Another optional feature of the invention is the use of a bowl shaped reflector as the reflecting surface.

BRIEF DESCRIPTION OF THE DRAWINGS

FIG. 21 is a perspective view similar to FIG. 2 showing the housing and front of the lighting fixture according to a preferred embodiment of the present invention.

FIG. 22 is similar to FIG. 6 and is a front elevational view of the fixture of FIG. 21, including a mounting post that is secured in the ground.

DETAILED DESCRIPTION OF THE PREFERRED EMBODIMENT

A. Overview

Figure 1:
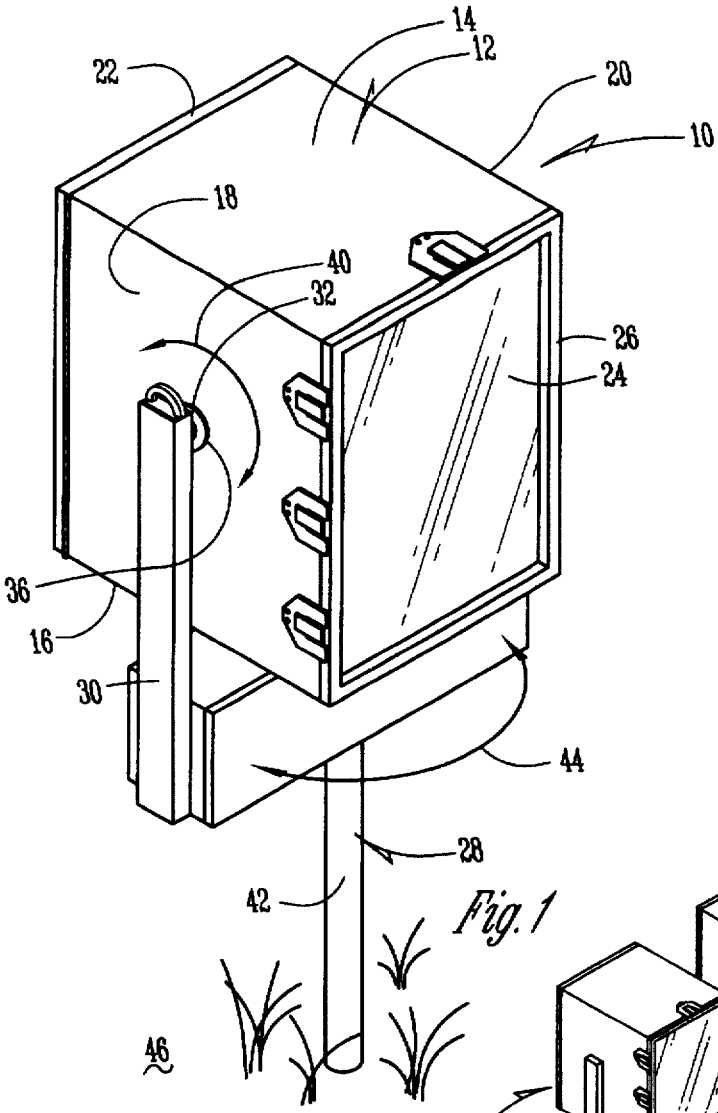
FIG. 1 is a perspective view of the front and right side of an enclosed light fixture.
Figure 1A:
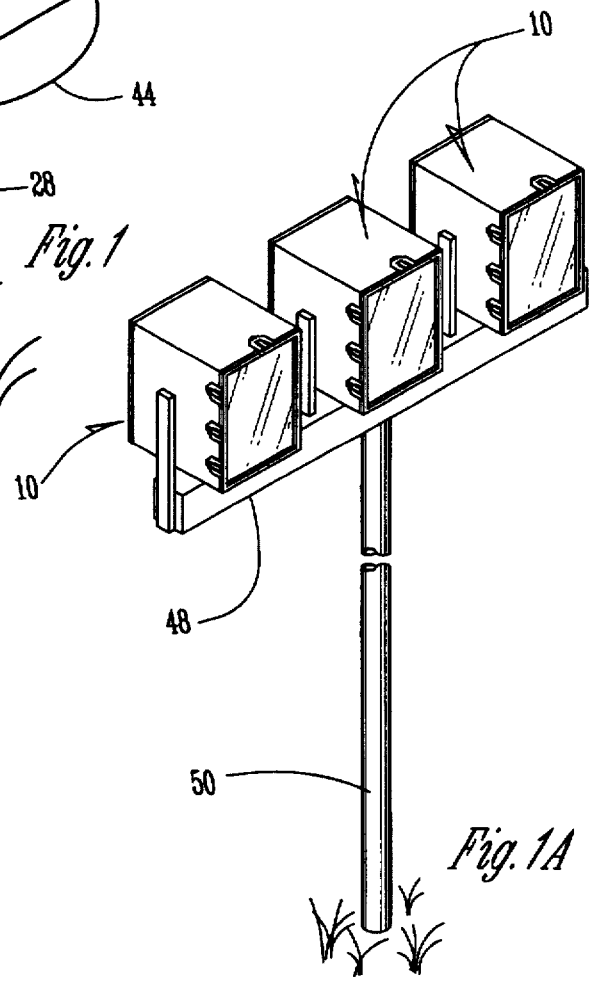
FIG. 1A is an elevational diagrammatical view of multiple apparatuses of FIG. 1 elevated on a pole.
Figure 6:
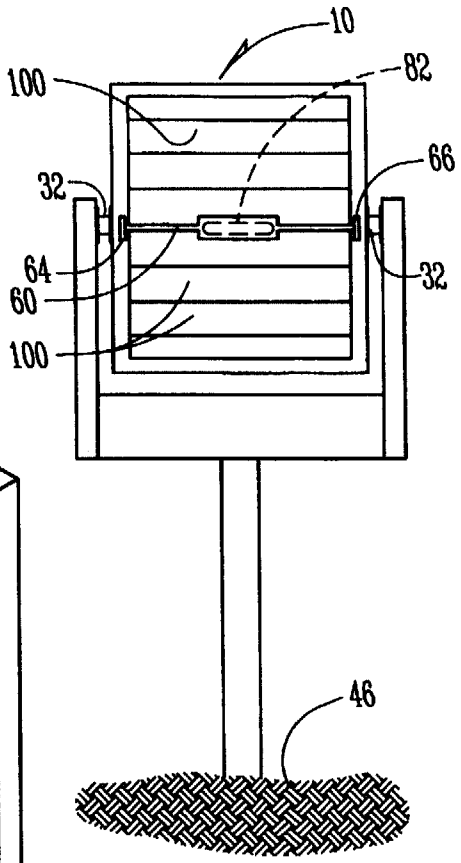
FIG. 6 is a simplified reduced front elevatiorial view of FIG. 2.
Figure 2:
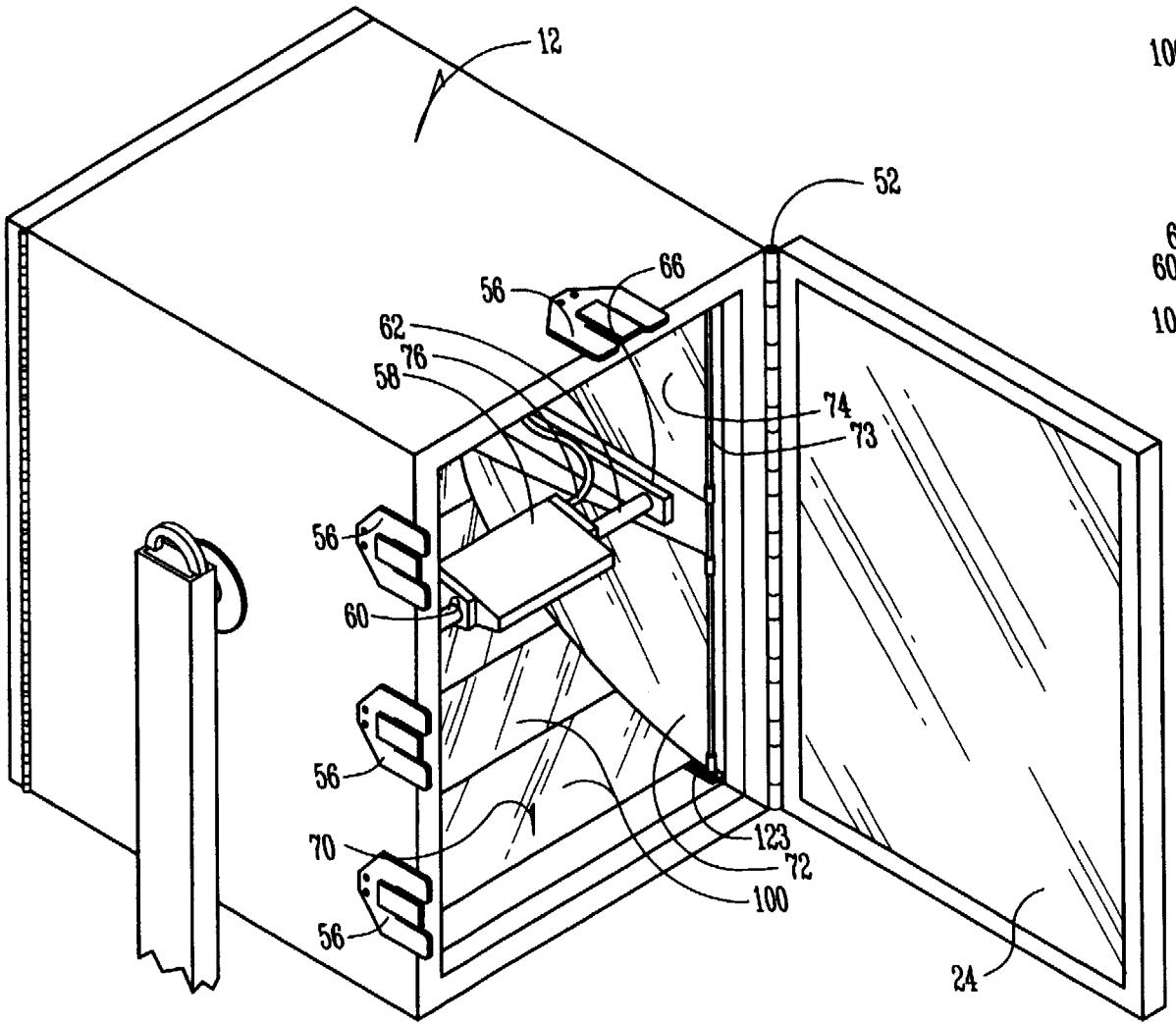
FIG. 2 is an enlarged isolated perspective view of the apparatus of FIG. 1 with the front lens shown in an open position. The large secondary reflector, and the mount for the light source and primary reflector are partially shown in the interior of the housing of the fixture.
Figure 5:
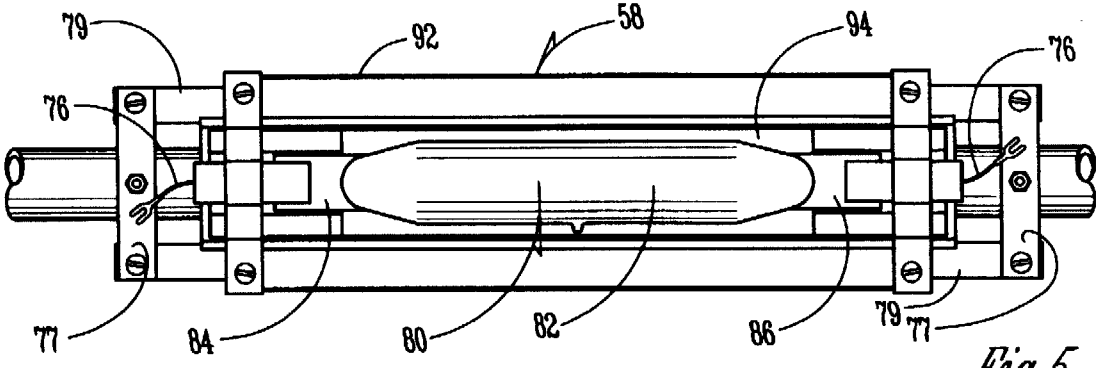
FIG. 5 is a rear elevational view taken along line 5—5 of FIG. 4.
Figure 3:
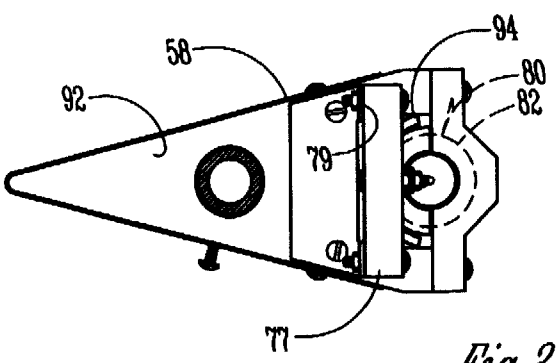
FIG. 3 is a side elevational view taken along line 3—3 of FIG. 4.
Figure 4:
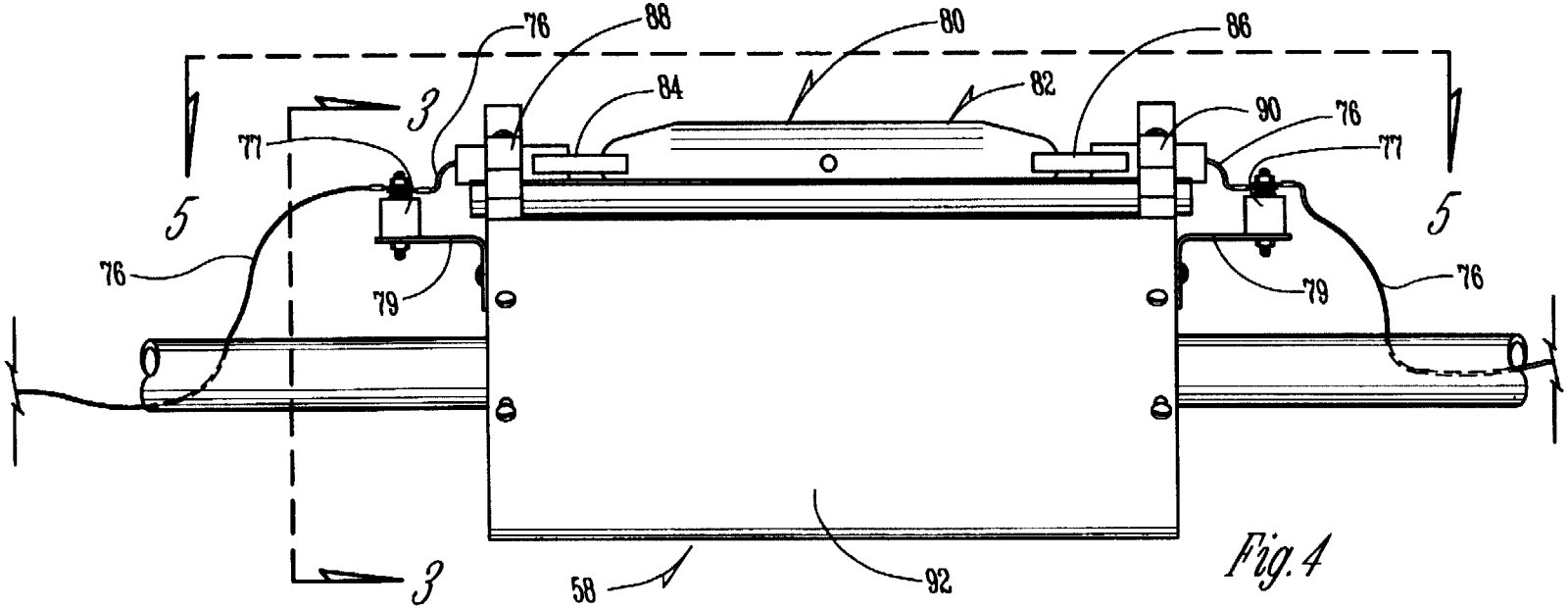
FIG. 4 is an enlarged top plan view of the light source mount of FIG. 2.
Figures 7A, 7B, 7C, 9A:
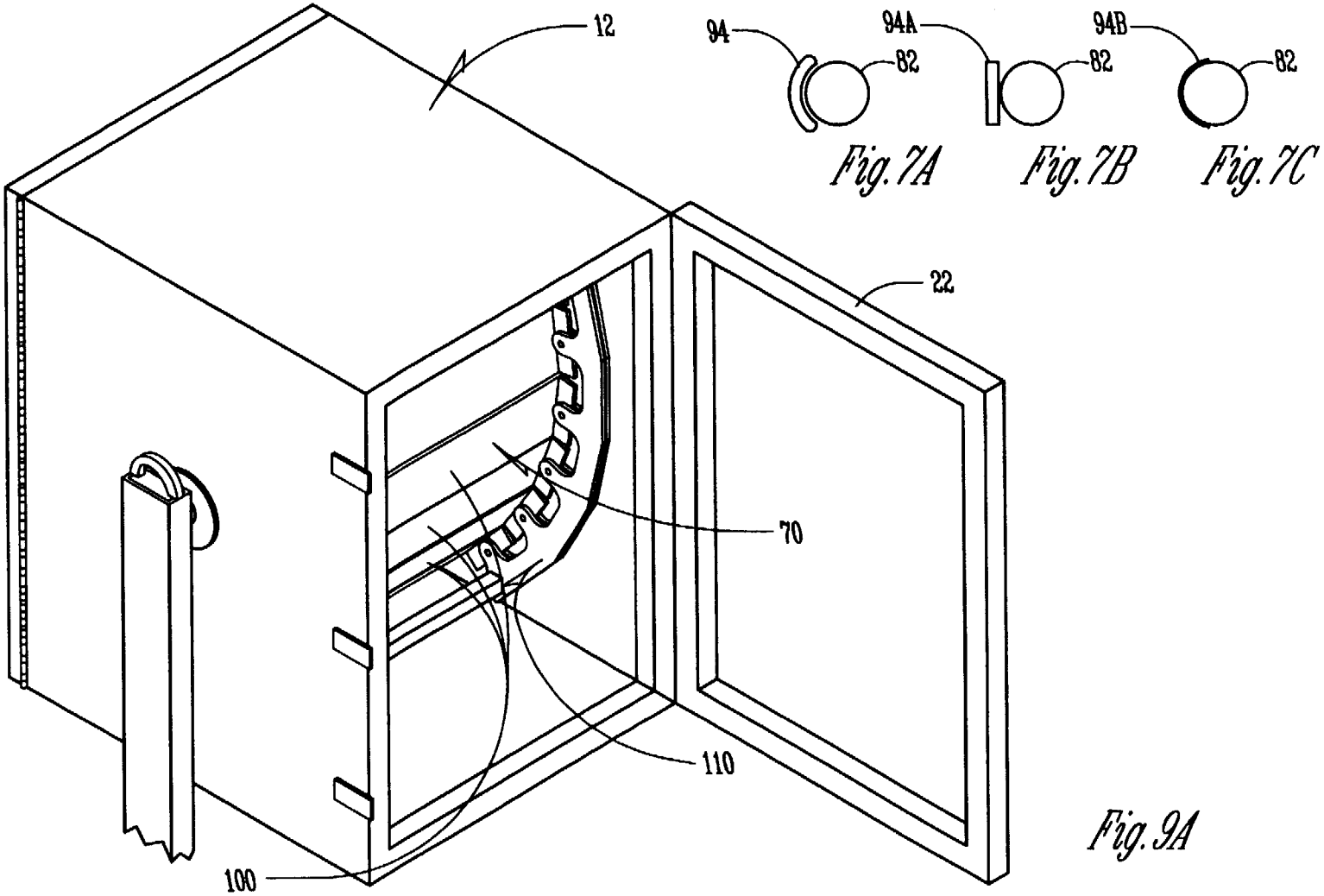
FIG. 7A is a side elevational diagrammatic view of a light source and a curved, separate primary reflector.
FIG. 7B is side elevational diagrammatic view of a light source and a flat, separate primary reflector.
FIG. 7C is a side elevational diagrammatic view of a light source and a primary reflector in the form of a coating.
FIG. 9A is an enlarged perspective view of the housing of the fixture of FIG. 9, showing the rear wall pivoted open and the back of the frame that supports the secondary reflector.
Figure 8:
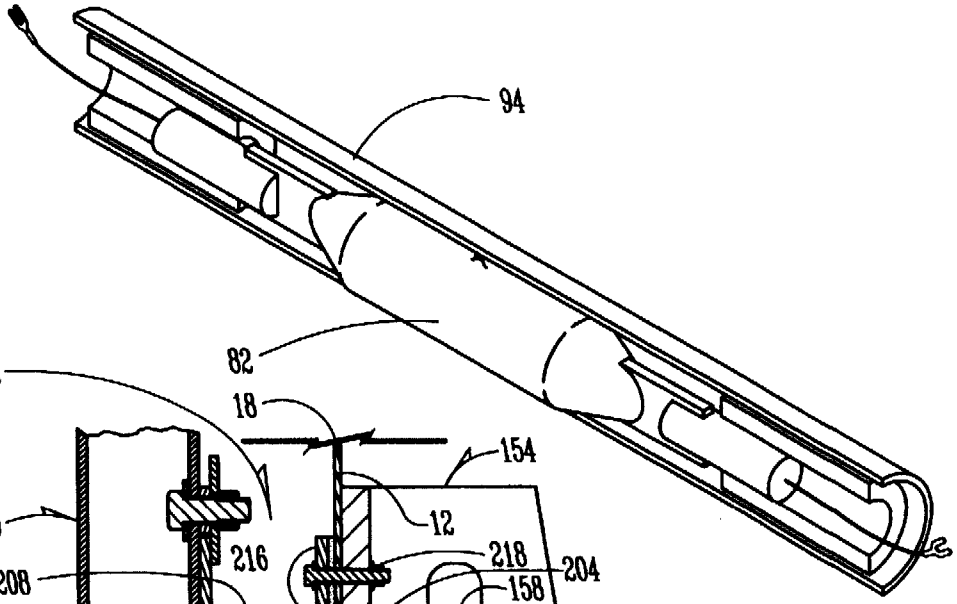
FIG. 8 is an isolated perspective of an embodiment of a light source and primary reflector.
Figure 18:
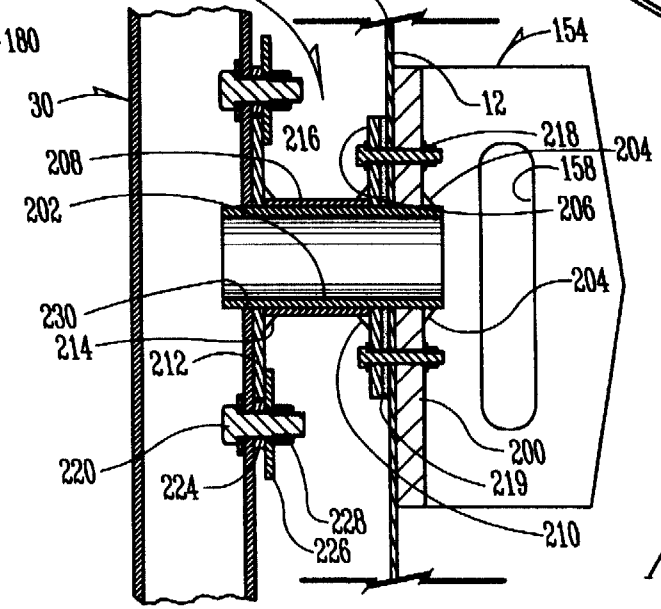
FIG. 18 is a sectional view taken along line 18—18 of FIG. 9.
Figure 11A:
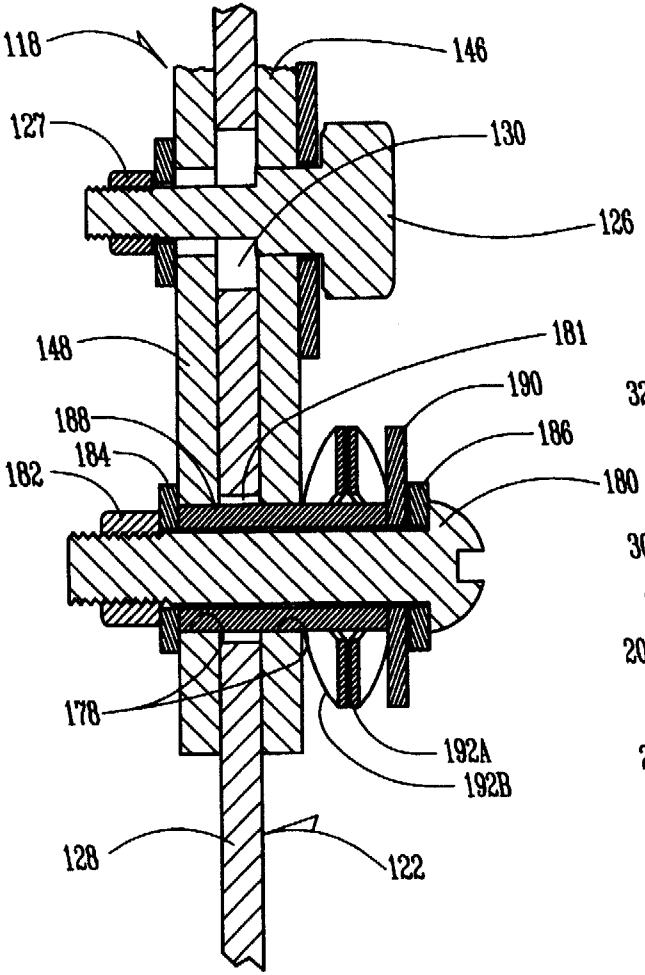
FIG. 11A is a sectional view taken along line 11A—11A of FIG. 11.
Figures 9, 14A, 14B:
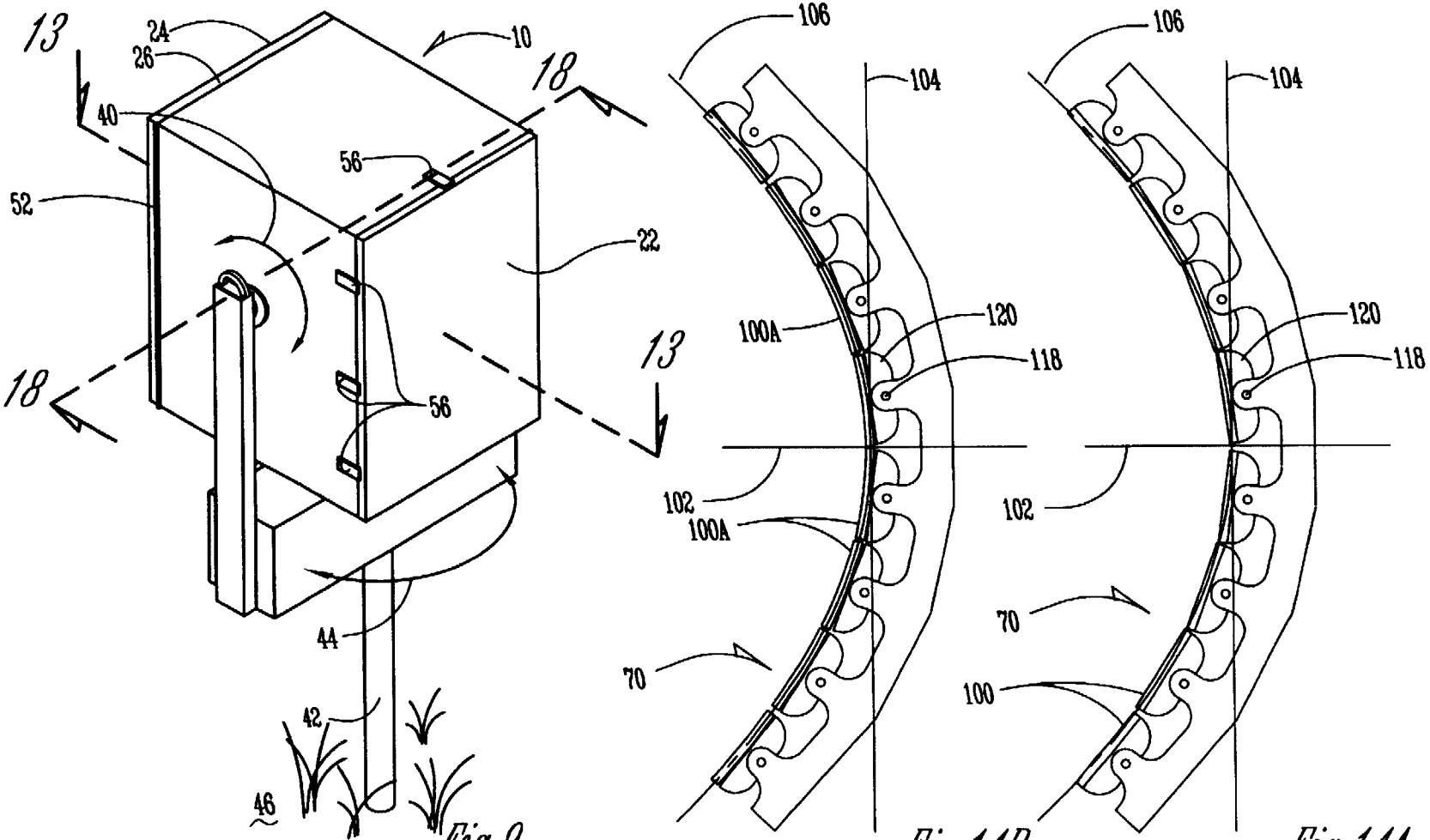
FIG. 9 is a perspective view of the rear and left side of the apparatus of FIG. 1.
FIG. 14A is an enlarged isolated view of the elevational side of the large secondary reflector and frame, showing diagrammatically the line along which individual reflector segments are situated.
FIG. 14B is similar to FIG. 14A but shows alternative reflector segments to those of FIG. 14A.
Figure 11:
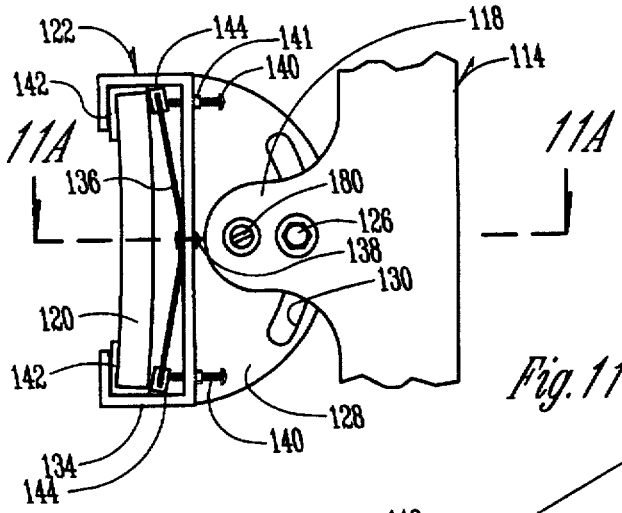
FIG. 11 is an enlarged side elevation of one mirror segment and connection components of one end of the segment to the frame of FIG. 10 taken generally from the viewpoint of line 11—11 of FIG. 10.
Figure 10:
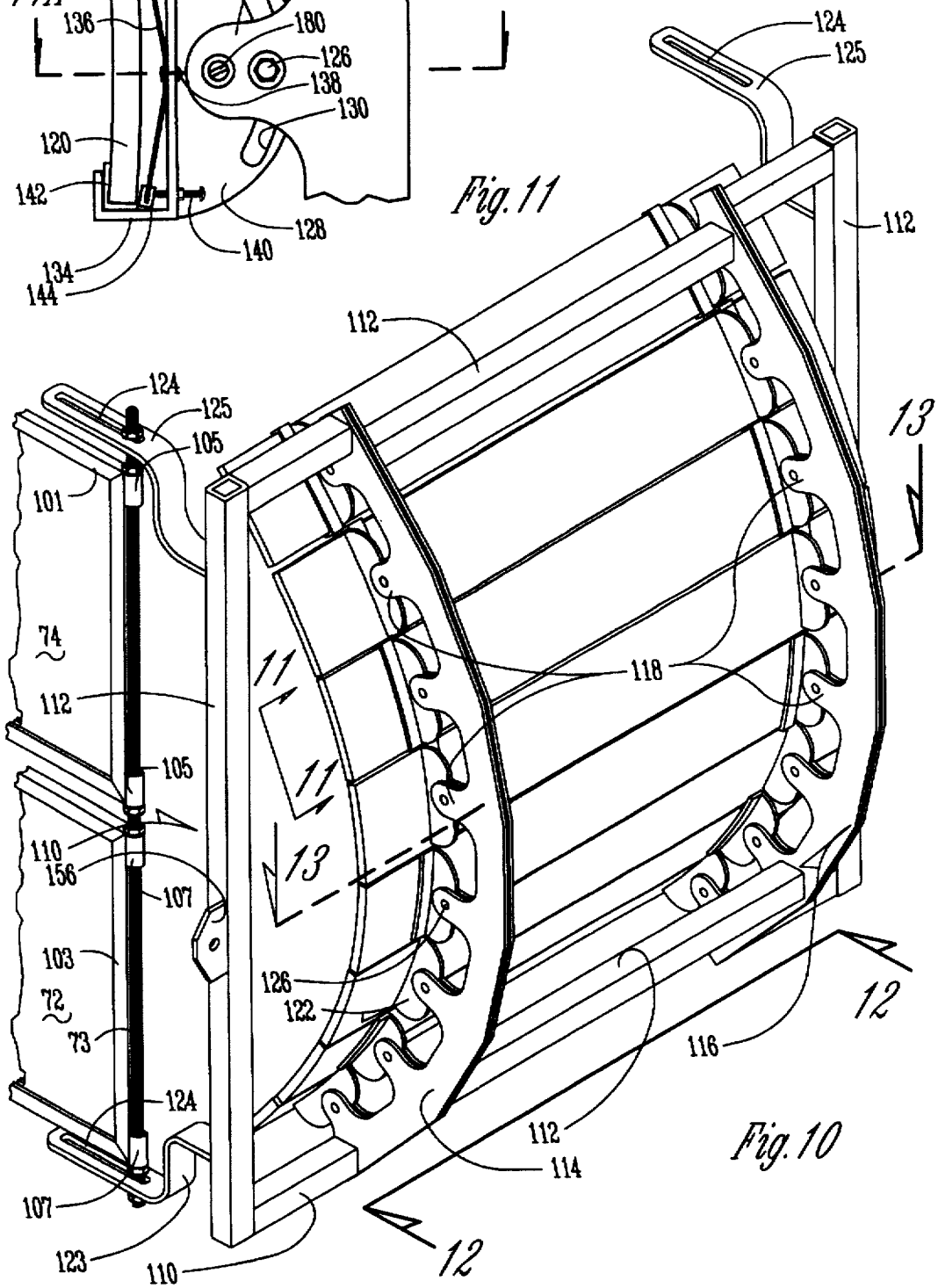
FIG. 10 is an enlarged isolated perspective view of the reflector frame with attached segments of the secondary reflector.
Figure 12:
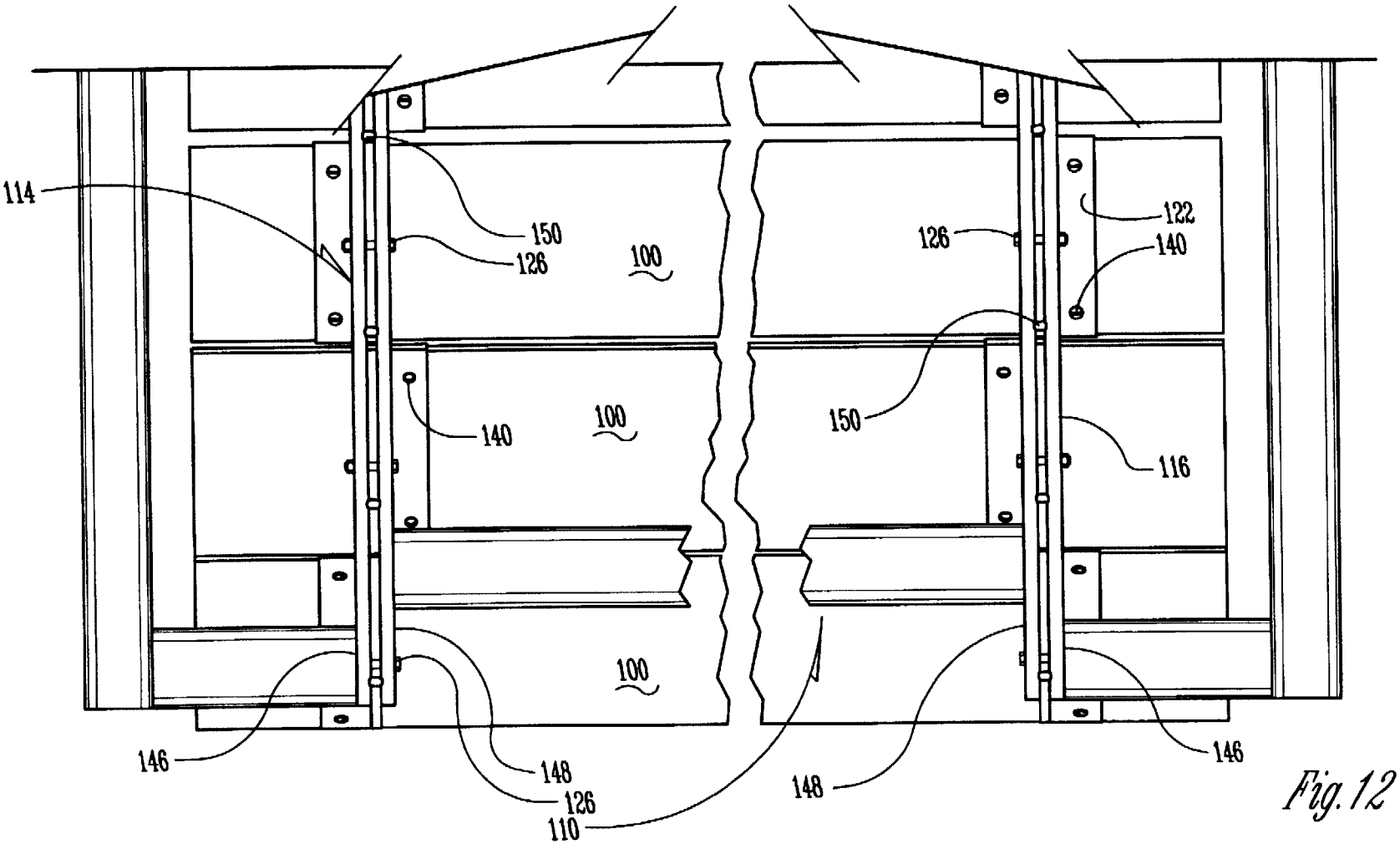
FIG. 12 is an enlarged partial back elevation of FIG. 12 taken along line 12—12 of FIG. 10.
Figure 13:
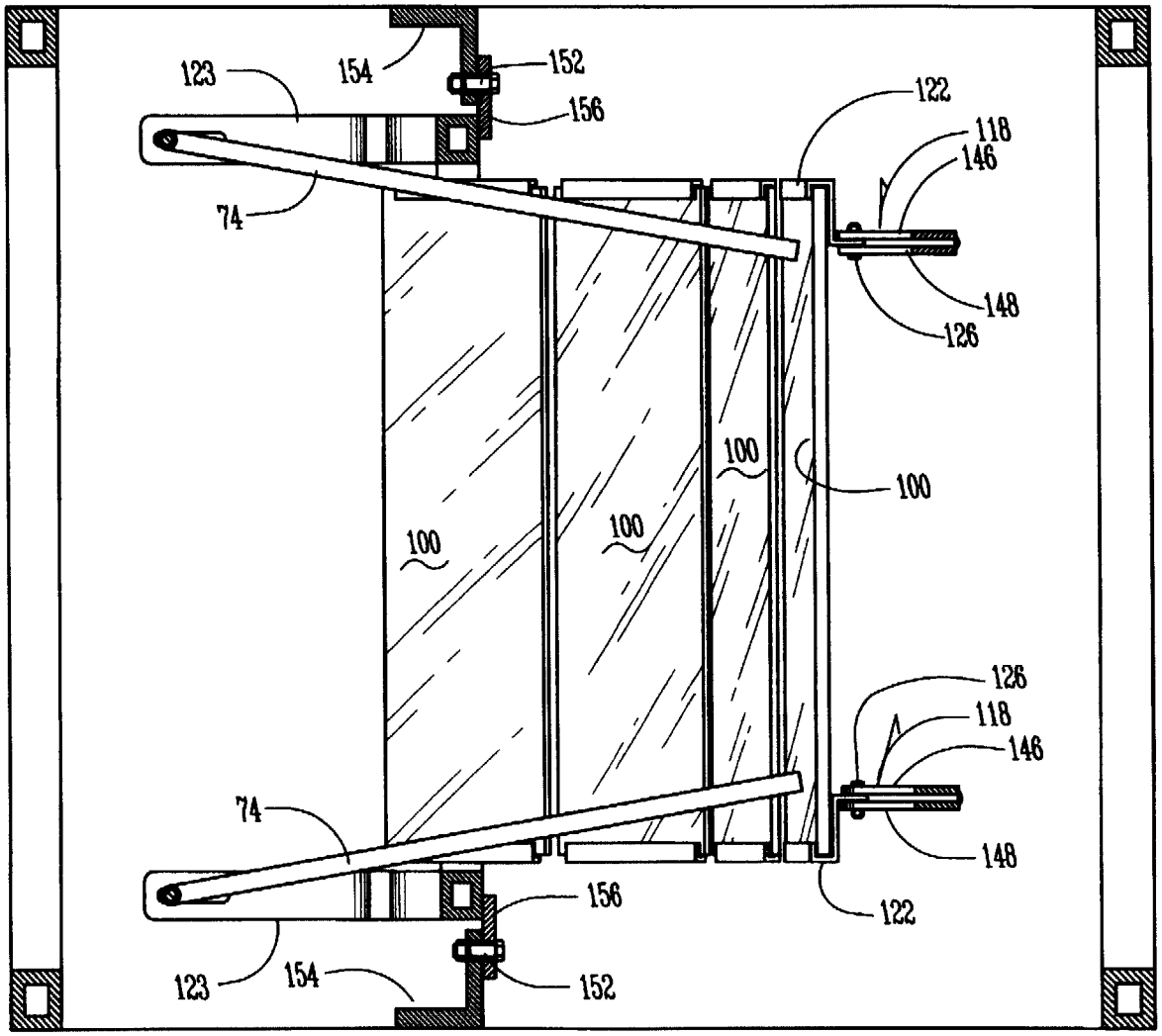
FIG. 13 is an enlarged sectional view of part of the interior of the housing of FIG. 9 showing the positioning of the large reflector frame in the housing, taken generally along line 13—13 of FIG. 9.
Figure 16:
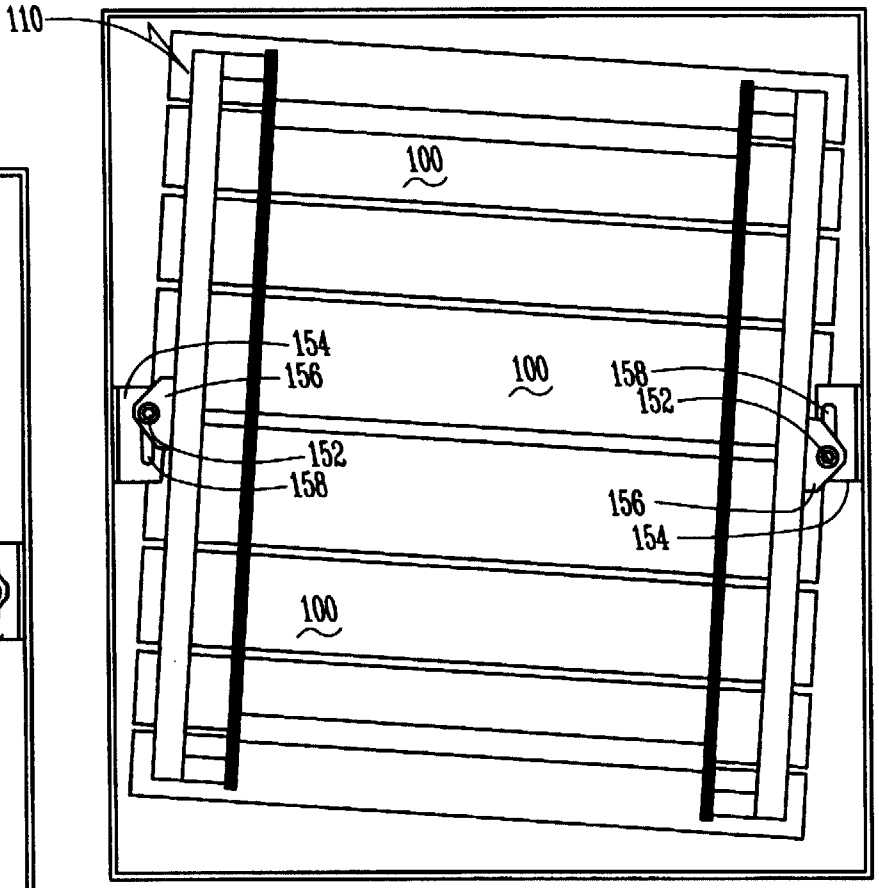
FIG. 16 is a similar view to FIG. 15 but showing the frame of FIG. 10 adjustably tilted in the fixture.
Figure 15:
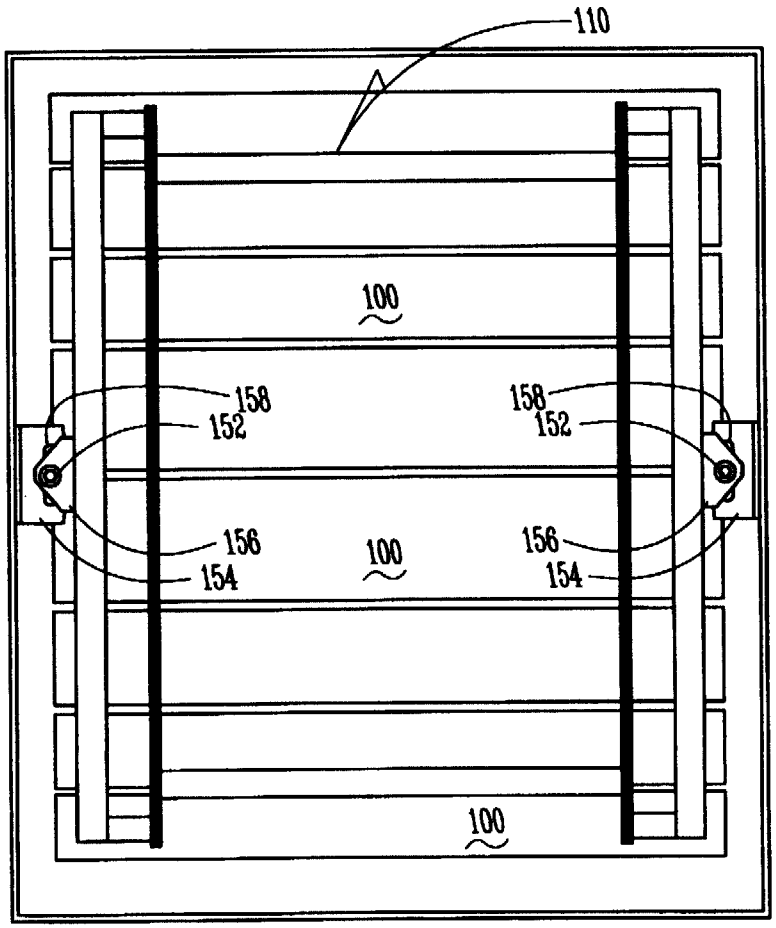
FIG. 15 is a rear elevational view of the interior of the fixture housing with the rear wall removed, showing the mounting of the secondary reflector on brackets allowing the adjustability of the frame of FIG. 10 in the fixture.
Figure 17:
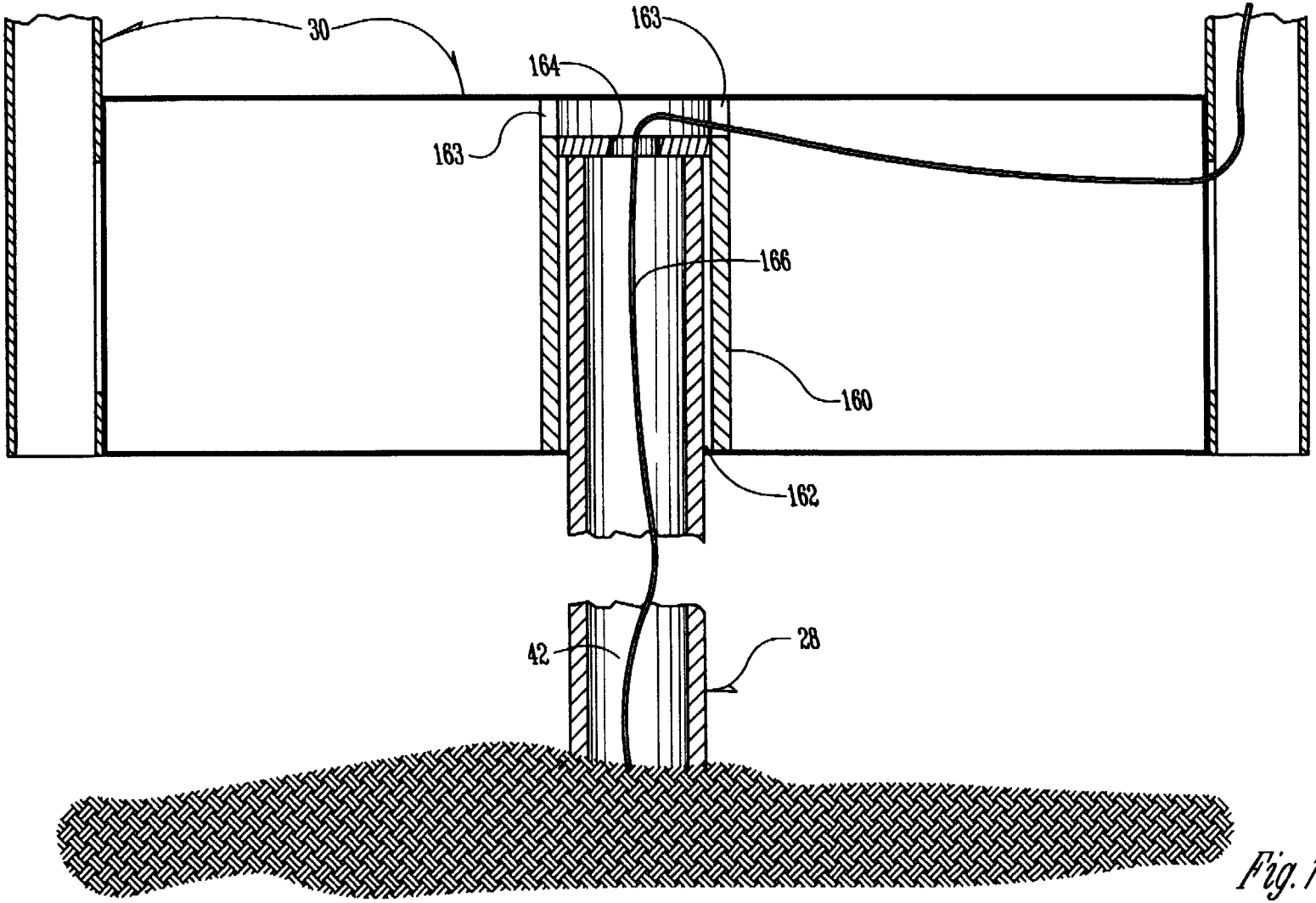
FIG. 17 is a vertical sectional view through the fixture of FIG. 1 showing how the support pole is mounted to the lower trunnion box.
Figure 19:
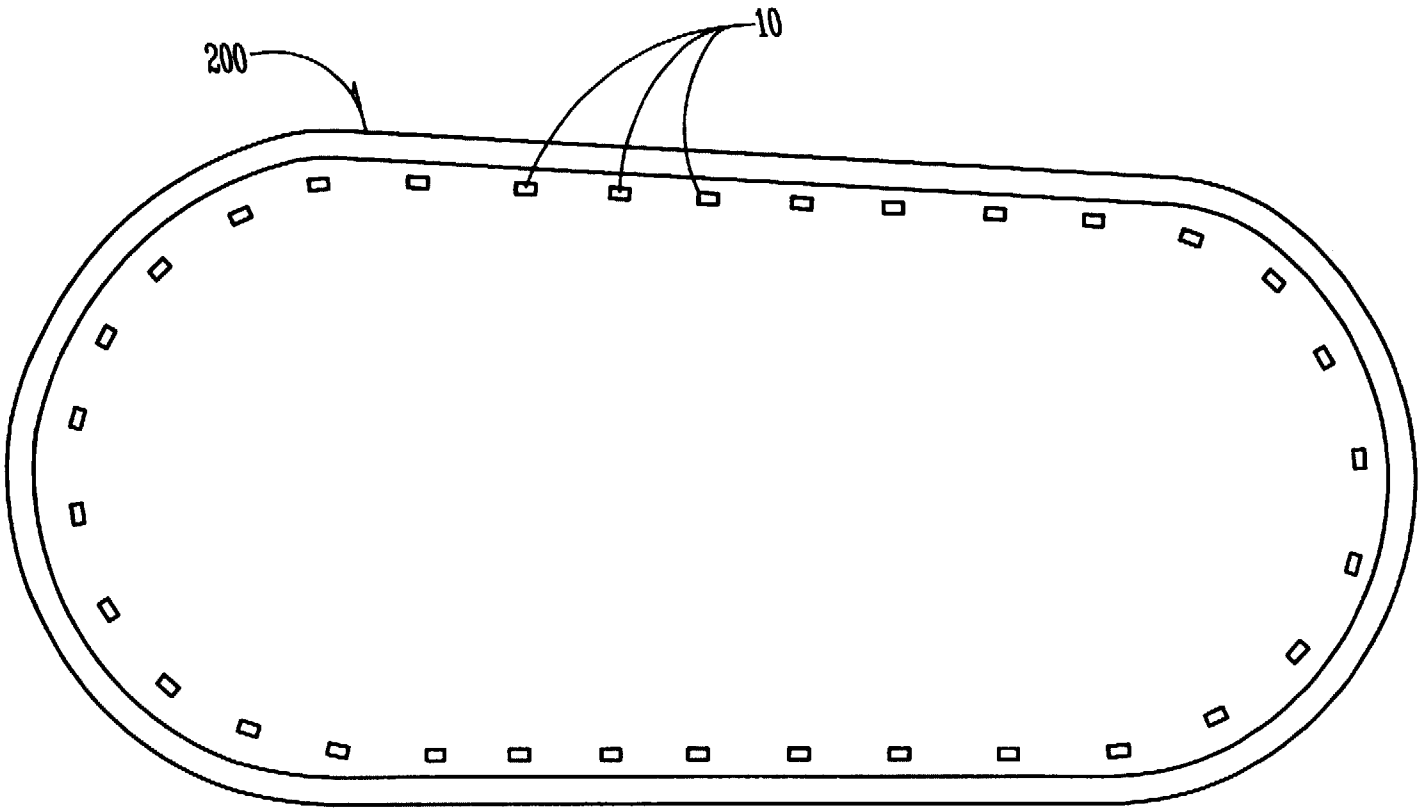
FIG. 19 is a top plan view of a race track showing diagrammatically one example of positioning of apparatus according to FIG. 1 around the interior of the track.
Figure 20:
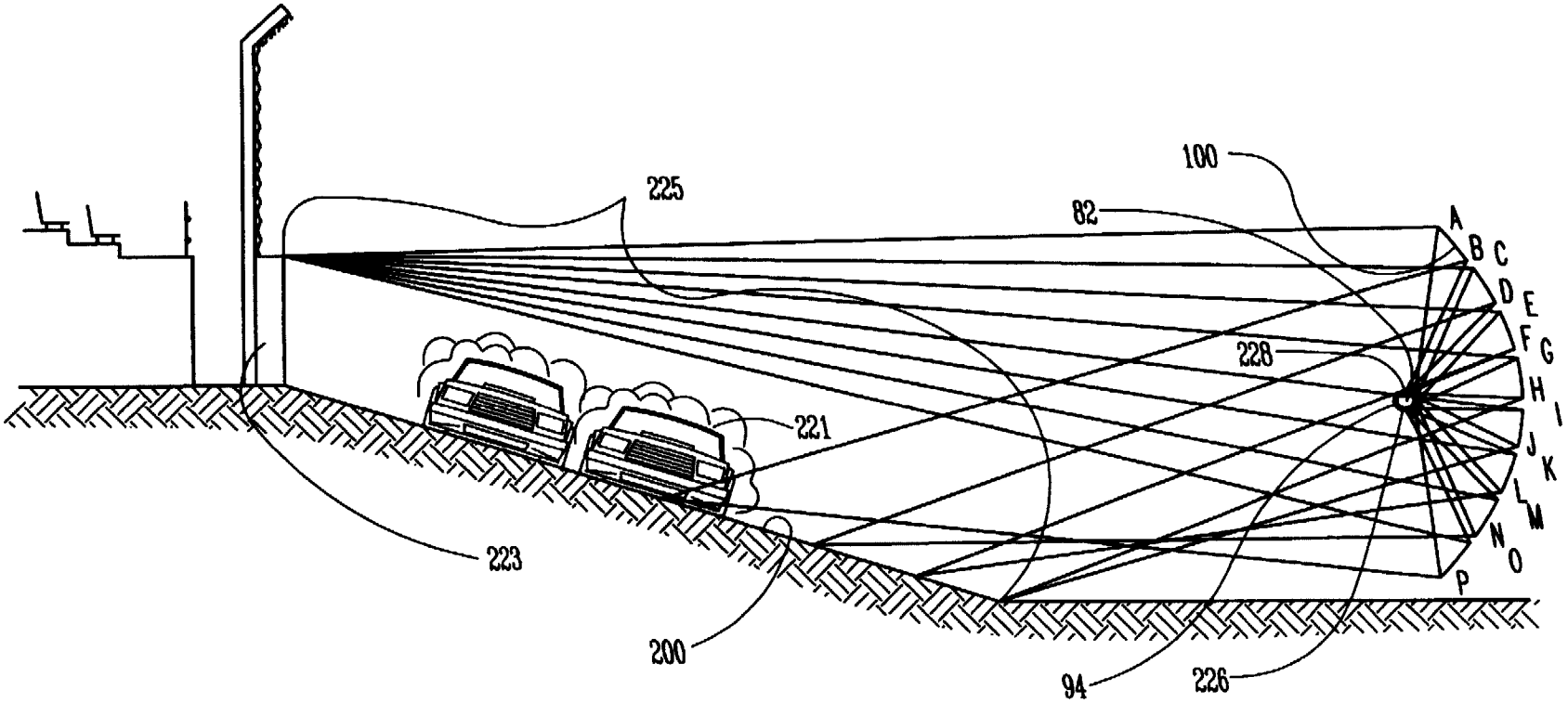
FIG. 20 is a diagrammatic side elevational view illustrating the creation of a defined cutoff for the beam from a fixture according to FIG. 2.

To assist in an understanding of the invention, one embodiment will be described in detail. It is to be understood that the description of this embodiment is for exemplary purposes only and does not nor is it intended to limit the scope of the invention.

FIGS. 1–20 disclose a lighting fixture 10 having an enclosure 12 can be mounted to a yoke 28 that allows for positional orientation of the entire enclosure 12 relative to a target area. Enclosure 12 can be pivoted around a vertical axis and around a horizontal axis (see particularly FIGS. 1, 2, 6, 9, 11A, 16, and 18). FIGS. 1–20 also disclose a transparent front window 24 as well as a light source mount 58 that includes a high intensity discharge light source 82 (see particularly FIGS. 2–6). FIGS. 1–20 disclose the ability for the light source mount 58 to include what is called a primary reflector 94 which is of a size, and can be of a shape, that is on the same order of size and shape as the light source 80 itself (see particularly FIGS. 2–6, and FIGS. 7A–C, and 8). The primary reflector 94 can be a separate piece or attached or coated onto light source 82. It can be made of ceramic material such as aluminum oxide. Other materials are possible.

As can be seen in FIGS. 1–20, a secondary reflector, receiving light directly from light source 82 as well as light reflected from primary reflector 94, utilizes mirror segments 110 as the reflecting surfaces for capturing and controlling light energy from light source 82 and primary reflector 94 to then create a controlled concentrated light beam to the target area.

The embodiment according to the present invention utilizes many of the concepts disclosed in FIGS. 1–20. In particular, housing 12, yoke mount 28, and light source mount 58 are similar in size and function. Primary reflector 94 can be the same. Of course, variations can be made to each of those components while staying within the scope of the invention.

The major difference between the fixture of FIGS. 1–20 and that of the embodiment according to the present invention, as shown in FIGS. 21–41, will be described below.

Instead of utilizing mirrored segments to form a curved surface along the shape of a parabola, light fixture 600 according to the present invention utilizes a bowl shaped reflector 610 (see FIGS. 22 and 23) placed within enclosure 12. As can be seen by referring to FIG. 23, bowl shaped reflector 610 is mounted to cross-arms 622 and 624 which are in turn fixed to upstanding rails 619. Square tubes 620, fixed to opposite ends of each rail 619, receive feet 618 to complete what will be called the Frame 616 that supports reflector 610.

Figure 22A:
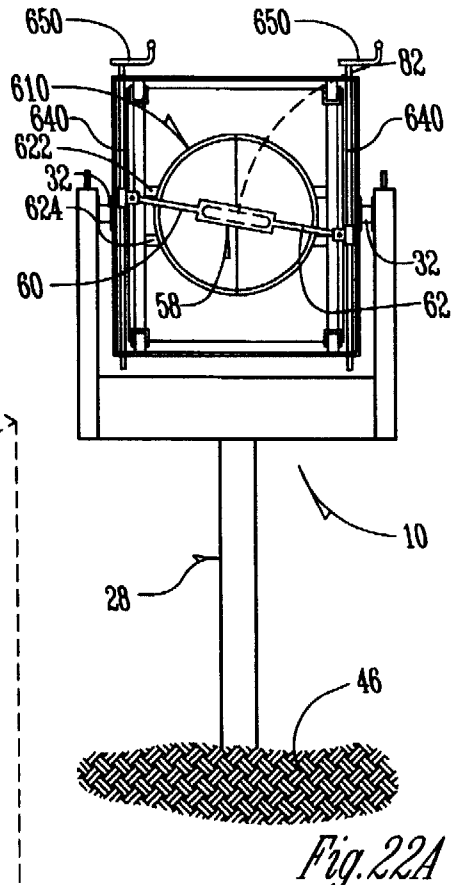
FIG. 22A is similar to FIG. 22 except that the light source is tilted or rotated from its position shown in FIG. 22.

FIG. 21 illustrates how light source holder 58 is attached to lateral arms 60 and 62 which are in turn attached at outer ends to tubes 648 which are slideable along threaded rods 640. Nut pair 646 and 647 (two nuts threaded onto threaded rod 640), provide a rest for tubes 621 along rods 640. Nuts 625 and 627 attached to the top and bottom of housing 12 respectively, and allow rod 640 to move upwardly or downwardly relative to housing 12 according to the rotation of handle 650. Therefore by operating both handles 650, the light source mount 58, and therefore the light source 82, and primary reflector 94 if used, can be raised or lowered vertically relative to housing 12, and more particularly relative to reflector 610. Note that arms 60 and 62 are connected to tubes 648 by pivot connections 649 (first and second flat portions attached to an arm 60 or 62 and a tube 648 respectively, with a pin extending through aligned apertures in both flat positions and held in that position). This allows the light source holder to be pivoted or tilted generally in the plane defined by the rods 640. This not only prevents binding of the entire assembly related to light source holder 58 as it is moved up or down, but also allows arms 60 and 62 to be moved independentaly which allows light source 82 to be angled. An example of such tilting is shown in FIG. 22A where light source mount 58 and light source 82 are tilted or canted from generally horizontal. Such tilting of the light source may be desired for certain lighting effects.

It is to be understood that a variety of ways of allowing adjustable positioning of light source mount 58 are within the scope of the invention and are within the scope of those skilled in the art.

FIG. 22 illustrates light source 82 in light source holder 58 in a general centered position relative to reflector 610. FIG. 22 also illustrates reflector 610 generally centered within housing 12, and how the entire housing 12 is mounted on yoke 28.

Figure 23:
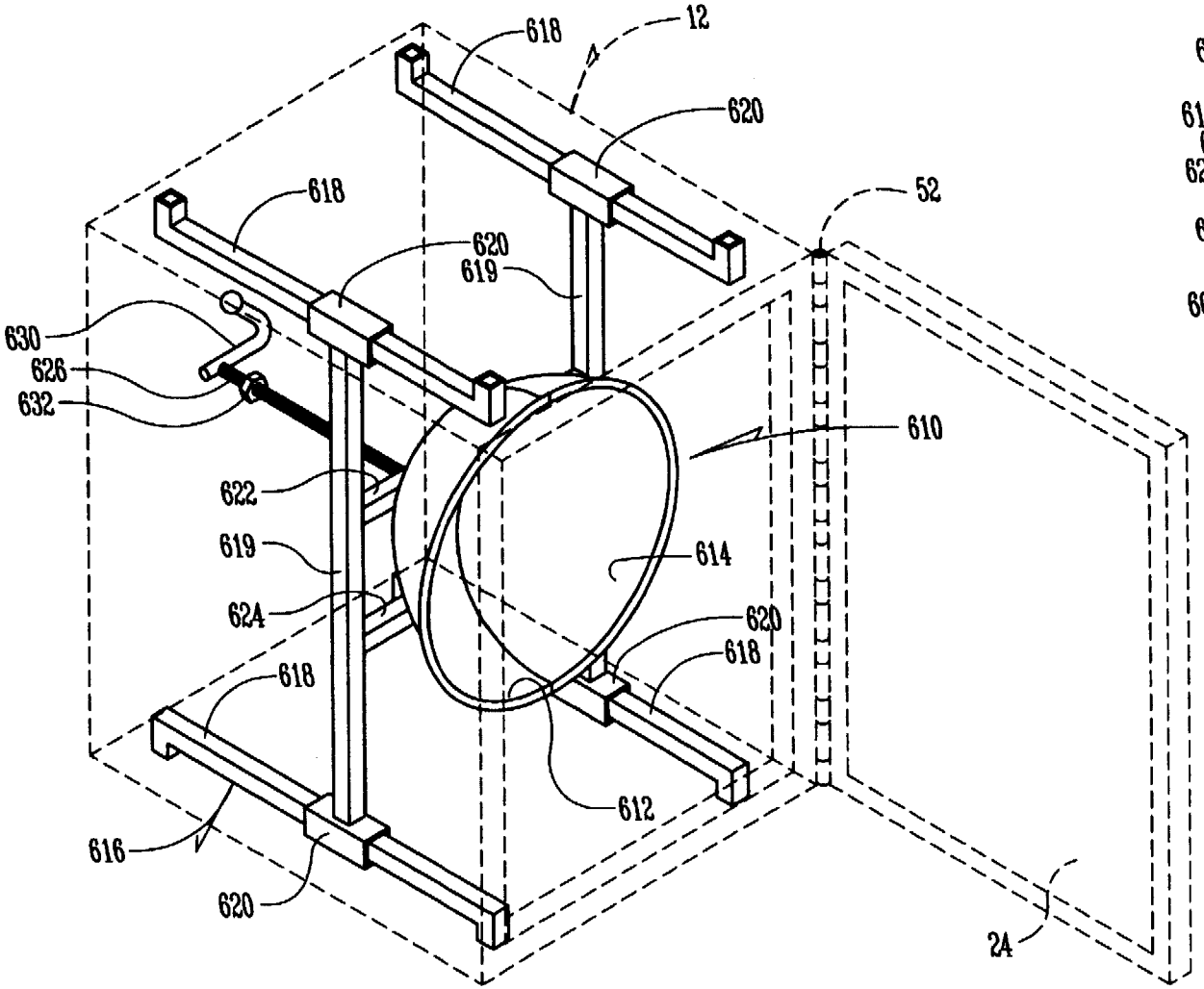
FIG. 23 is a perspective view of some of the interior contents of the fixture of FIG. 21, showing the outer housing for the lighting fixture in ghost lines.

FIG. 23 illustrates not only frame 616, but also the structure that allows reflector 610 to be moved frontwards and backwards within housing 12, relative to the front door 24. A threaded rod 626 extends from a bracket 652 (which is attached to the back of reflector 610, see FIG. 24) through an aperture in the back of housing 12. A nut 632 is secured by welding or otherwise to the back of housing 12 in alignment with the aperture of the back of housing 12. Handle 630 can be rotated to move threaded rod 626 forward or rearwardly in housing 12 to in turn move the sub-frame comprised of cross-arm 622 and 624 and rails 619 along the feet 618. Square tube 620 are sized so as to slide along feet 618. Feet 618 are fixed to the top inside and bottom walls of housing 12 by welding or otherwise.

Figure 24:
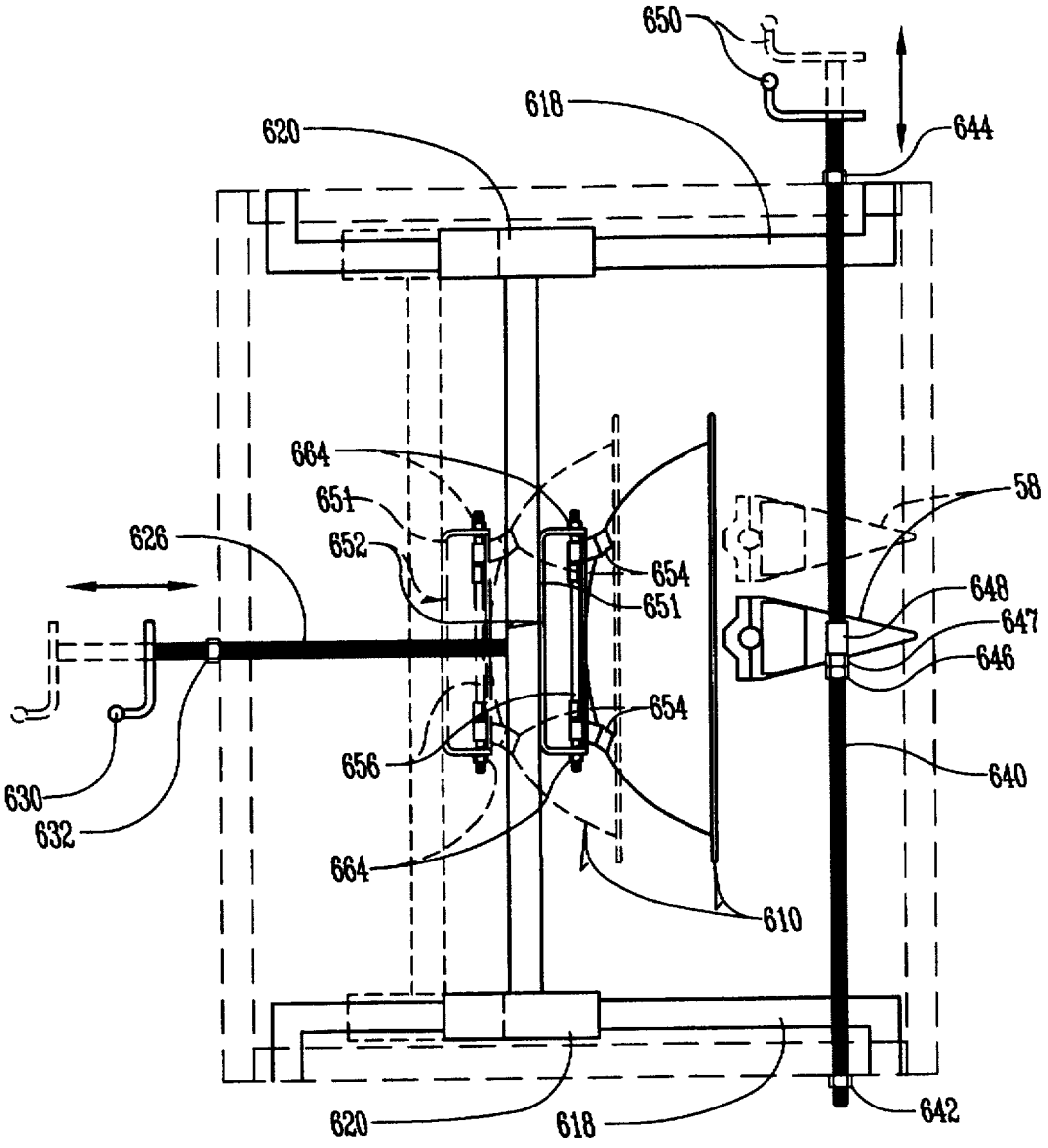
FIG. 24 is a side elevational view of interior components of the fixture of FIG. 21, showing the outer housing in ghost lines, the secondary reflector and the light source and the possible movement of the light source and reflector relative to one another.

Thus, a second type of adjustable movement of elements of fixture 600 is shown in that reflector 610 can be moved towards or away from front of housing 12, and thus can be moved towards or away from light source 82 (not shown in FIG. 23, but see FIG. 24).

FIG. 24 illustrates examples of both forward and rearward movement of reflector 610 as well as the vertical movement of light source mount 58. The amount of vertical movement of light source mount is limited only by the length of rod 640 and the walls of housing 12, but of course, generally such movement will not be needed outside the perimeter of reflector 610, and most times will stay well within that perimeter.

FIG. 24 also illustrates connection mount 652 between cross-arms 622 and 624 of frame 616 and reflector 610. By referring to FIG. 24 in association with FIGS. 25–29, it can be seen that U-shaped bracket 651 extends rearwardly and is welded or otherwise secured to cross-arms 622 and 624 (see FIGS. 24 and 28). A rod 656, threaded at opposite ends, extends through apertures in the parallel, spaced apart opposite ends of bracket 651. First and second plates 658 and 662 extend in opposite directions from U-shape member 651. Plates 658 and 662 are pivotally connected to rod 656 in a similar construction to a standard door hinge plate 652 has ears 666 that are formed into tools that receive rod 656. Likewise plate 624 has ears 665 that receive rod 656. Reflector mounts 662 are bolted, riveted, or otherwise secured to the four corners of the rectangle defined by the two plates 658 and 660 as seen in FIG. 25, and extend at roughly 45° angles to the outer surface of reflector 610 where they are welded or otherwise secured in place to reflector 610.

Figure 25:
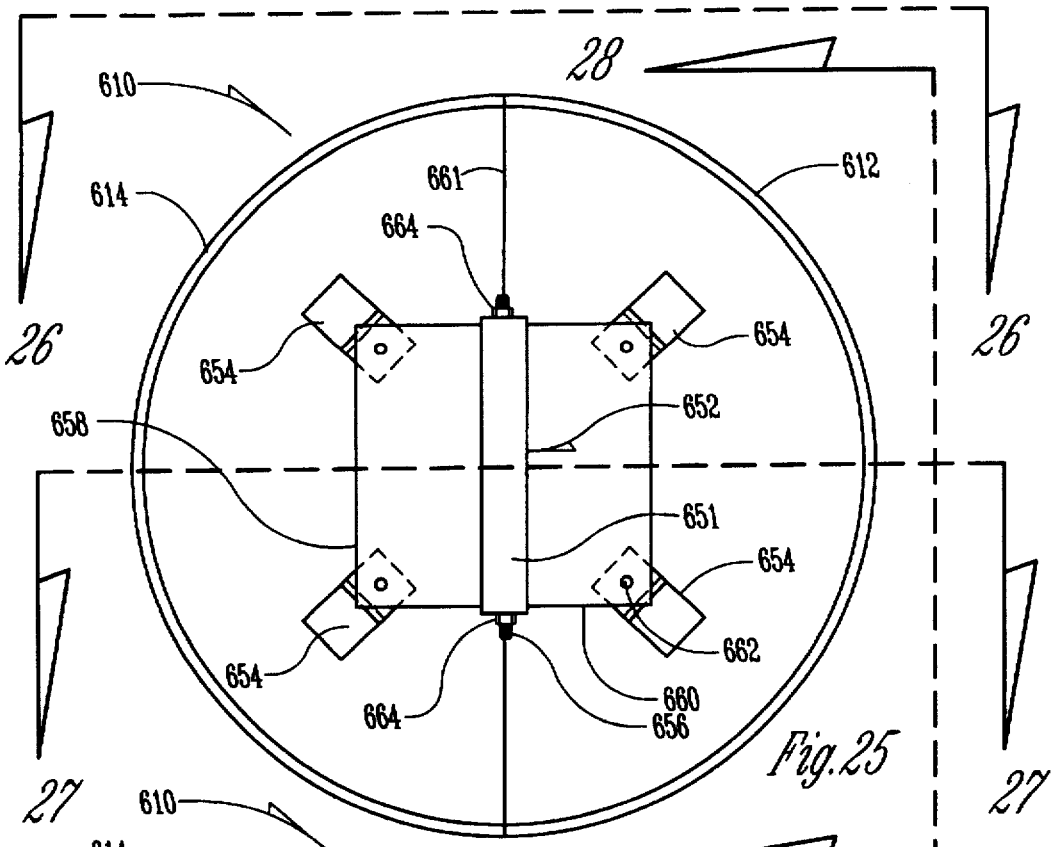
FIG. 25 is a rear elevational view of the reflector according to the embodiment of FIG. 21 taken generally along line 25—25 of FIGS. 24.
Figure 27:
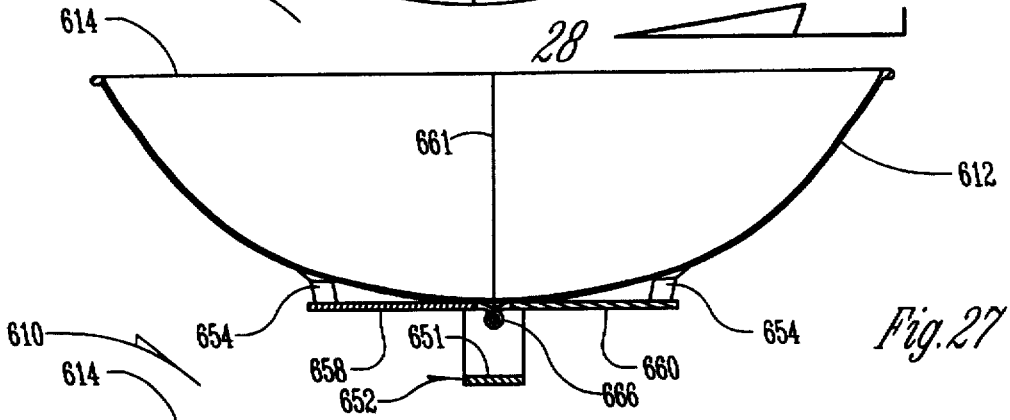
FIG. 27 is a sectional view taken along line 27—27 of FIG. 25.
Figure 26:
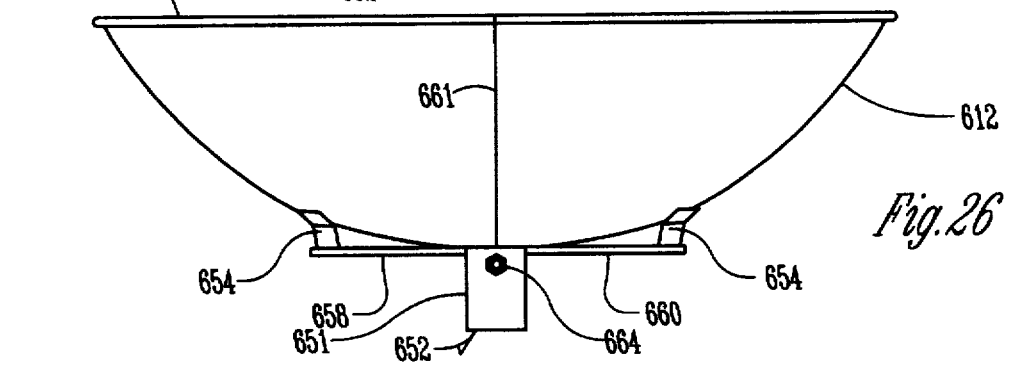
FIG. 26 is a top plan view taken along line 26—26 of FIG. 25.

As can be seen in FIGS. 25–27, reflector 610 is split along a split line 661. U-shaped bracket 651 is aligned along split line 661. Adjacent portions of plates 658 and 660 and rod 656 comprise a hinge (as described above).

Figure 29:
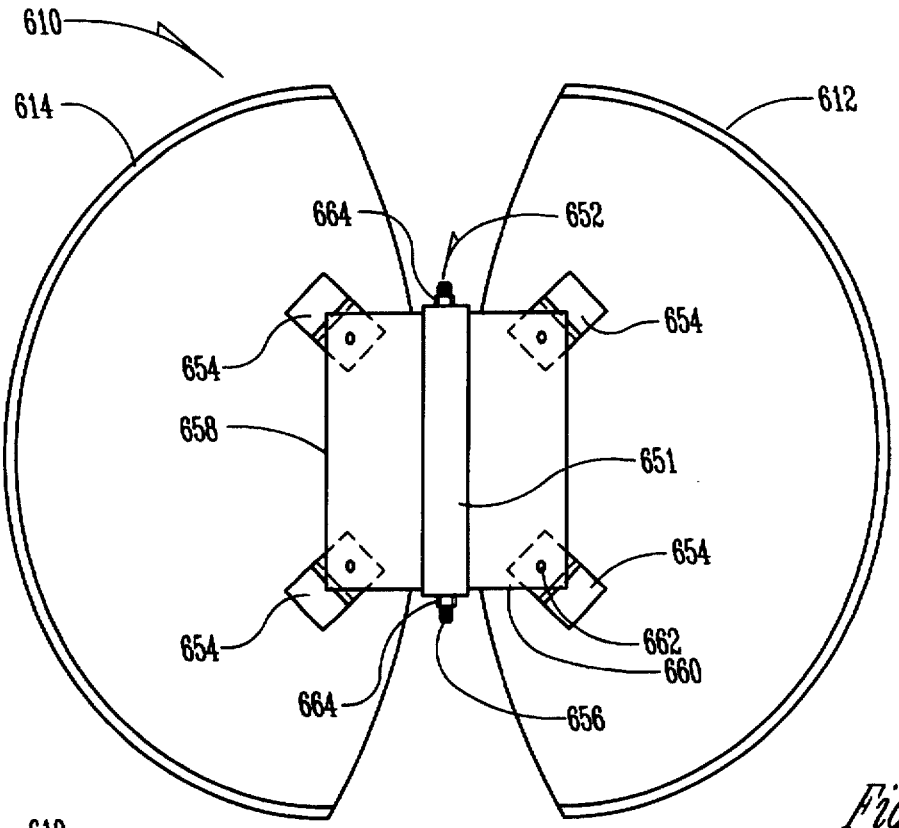
FIG. 29 is a rear elevational view similar to FIG. 25 but showing the reflector in its open position as opposed to the closed position shown in FIG. 25.
Figure 30:
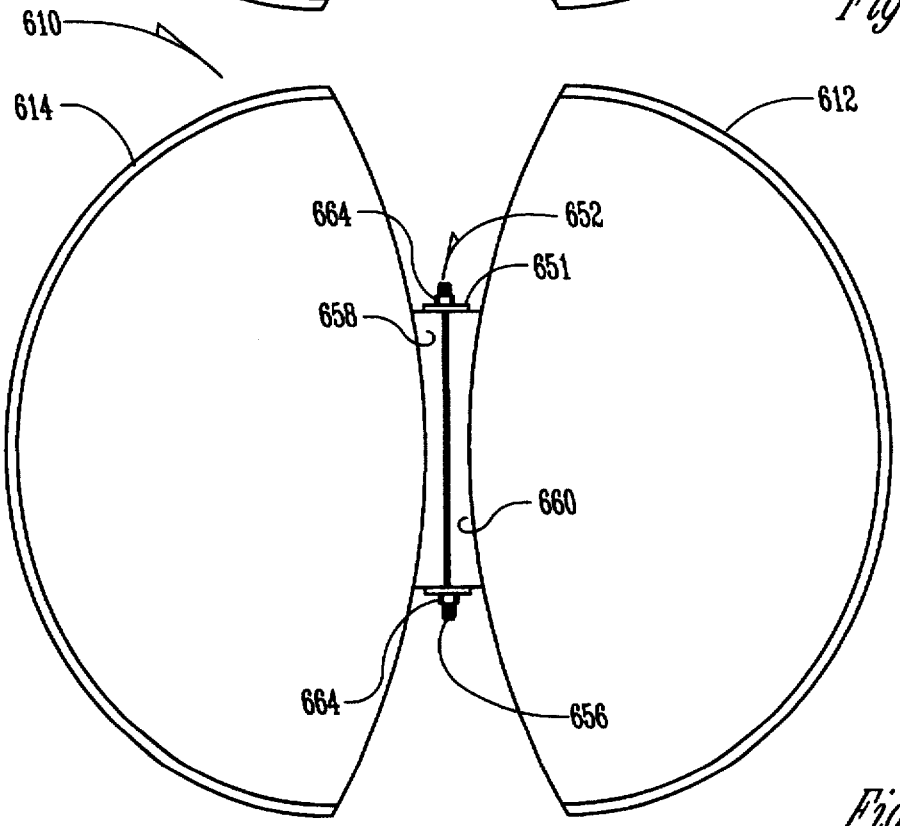
FIG. 30 is a front elevational view of FIG. 29.
Figure 28:
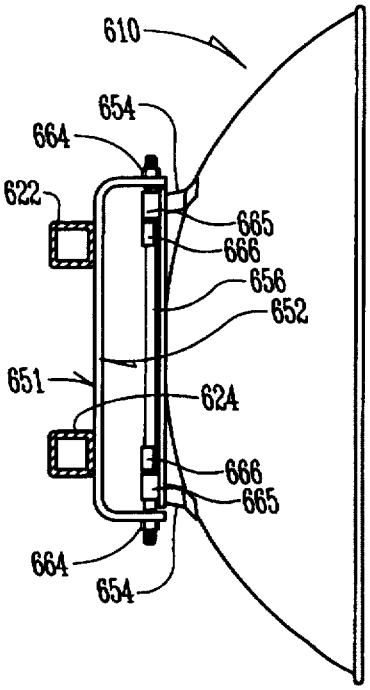
FIG. 28 is a side elevational view taken along line 28—28 of FIG. 25.

FIGS. 29 and 30 illustrate that bracket 652 allows reflector 610 to have opposite halves 612 and 614 opened or pivotably moved relative to one another. Nuts 664, threaded onto the threaded opposite ends of rod 656, can be loosened enough to allow the plates 658 and 660 to be moved relative to one another around the axis defined by rod 656. When reflector halve 612 and 614 are moved to a desired orientation relative to one another, nuts 664 are tightened. This compresses the hinge along the axis defined by rod 656 and locks reflector halves 612 and 614 in the desired orientation. Thus, FIGS. 29 and 30 illustrate an opening of reflector 610 whereas FIGS. 25–27 show reflector 610 in the closed position. The only limit to the extent of opening of reflector halves 612 and 614 relative to one another is when plates 658 and 660 come into abutment with bracket 651 or where reflector halves 612 and 614 would somehow come into abutment with part of frame 616 or housing 12.

Figure 31:
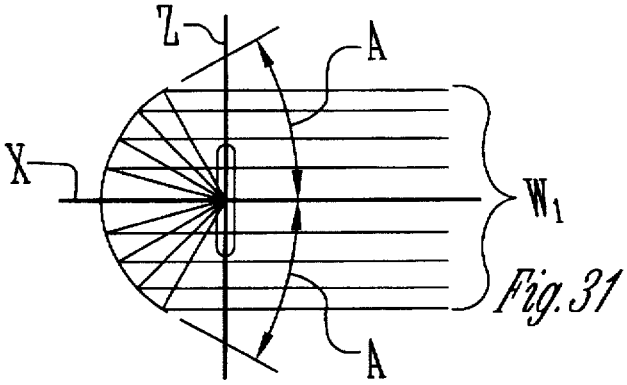
FIGS. 31 and 32 are diagrammatic top views illustrating the general change in shape of the beam pattern from a fixture according to the embodiment of FIG. 21 between a position where the reflector is closed (FIG. 31) or open (FIG. 32).
Figure 32:
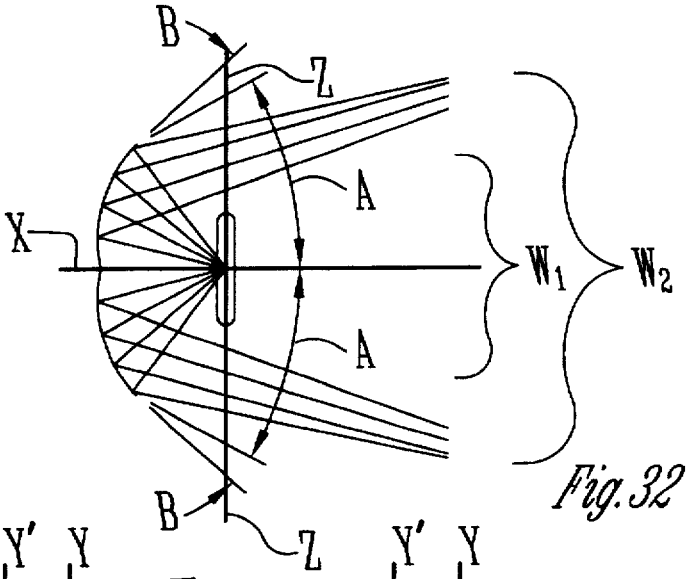

FIGS. 31–41 diagrammatically illustrate some of the different relational positionings of light source 82 relative to reflector 610, or the positioning of reflector halve 612 and 614 relative to one another and their general effect on the beam patterns or shapes that emanate therefrom. For example, FIGS. 31 and 32 show diagrammatically the difference between the horizontal beam pattern when reflector 610 is in a closed position (see beam $W_1$ in FIG. 31) and when it is in an open position (see beam $W_2$ in FIG. 32). In both FIGS. 31 and 32 light source 82 is in the identical location relative to the reflector 610. This is indicated by placement of light source 82 along the origin of the X and Z-axes in both FIGS. 31 and 32. In FIG. 31, the angle between the center axis X of reflector 610 and a line extending outwardly from the end of reflector 610 is shown as angle A. In this arrangement, with light source 82 basically along central axis 611 and at or near the focal point of reflector 610, results in plurality of generally collimated light rays going to the target area.

FIG. 32 shows that if reflector halves 612 and 614 are opened such as the position shown in FIG. 29 and 30 (and the additional angle B is added to angle A relative to ends of reflector 610), and light source 82 is in the same position as in FIG. 31, instead of the beam width and shape W1 of FIG. 31, a wider beam W2 (FIG. 32) would result.

Figure 33:
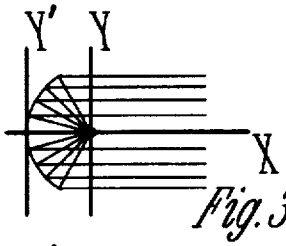
FIGS. 33–41 are diagrammatic views illustrating change in beam shape, size, orientation or pattern depending on the positional relationship of the light source to a reflector according to the embodiment of FIG. 21 where the reflector is in the closed position.
Figure 34:
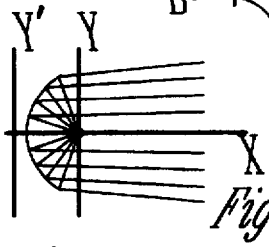
Figure 35:
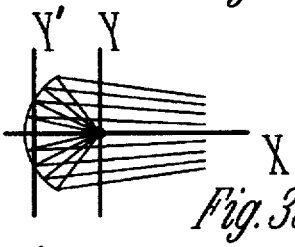

FIGS. 33–41 show a side diagrammatic view instead of the top view of FIGS. 31 and 32, how the position of light source 82 relative to reflector 610 varies the vertical beam shape. FIG. 33 shows light source 82 directly on what will be called right at the origin of the X and Y axes. In all instances in FIGS. 33–41, reflector 610 is in the closed position (such as shown at FIGS. 26 and 27). FIG. 33 shows basically collimated rays issuing in the vertical plane from the fixture. The light source 82 is basically at the focal point of reflector 610. The focal point here is designated as the original of the X and Y axes when reflector 610, along its center axis, intersects at the intersection of axes X and Y! By movement of reflector 610 along axis X closer to light source 82 as shown in FIG. 34, the beam is spread wider in the vertical dimension. FIG. 35 shows that the opposite is true if reflector 610 is moved farther away from light source 82 along the X-axis.

Figure 36:
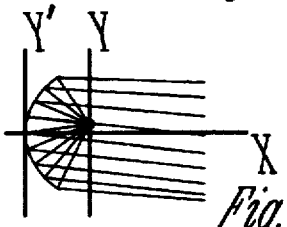
Figure 37:
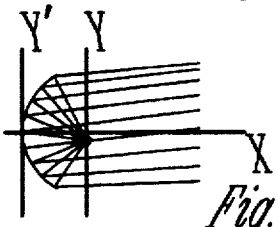
Figure 38:
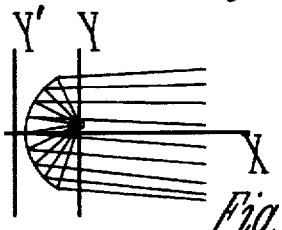
Figure 39:
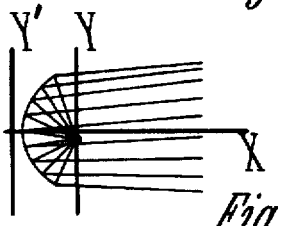

FIGS. 36 and 37 show that the beam can be directed downwardly (FIG. 36) or upwardly (FIG. 37) by raising or lowering light source 82 along the Y-axis respectively when reflector 610 is at the Y-axis. FIGS. 38 and 39 show that the beam can both be lowered and widened, or raised and widened by moving reflector 610 closer to light source 82 and then moving the light source above or below the X-axis.

Figure 40:
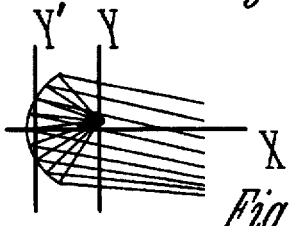
Figure 41:
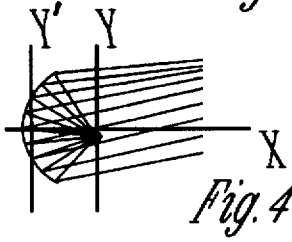

Finally, FIGS. 40 and 41 show that the beam can be narrowed and lowered or narrowed and lowered by moving reflector 610 away from light source 82 but above or below the X-axis.

It can therefore be easily understood that by combining any of the positions of FIGS. 33–41 with closing or opening the reflector as illustrated in FIGS. 31 and 32, a variety of different beam shapes and orientations can be achieved in both the vertical and horizontal planes.

It will be appreciated that the present invention can take many forms and embodiments. The true essence and spirit of this invention are defined in the appended claims, and it is not intended that the embodiment of the invention presented herein should limit the scope thereof.

For example, the precise shape and size of the reflector, its pieces, and the light source may vary. The light source does not have to be elongated but can be more compact or of different shapes and sizes.

I claim:

1. A lighting fixture producing a controlled, concentrated high intensity light beam comprising:

a reflecting surface;

a light source in a mount connected to the fixture and movably positionable relative to the reflecting surface;

the reflecting surface split along a plane into first and second portions that are pivotable with respect to one another generally along the split;

so that movement of the light source and/or the first and second surfaces cause the light beam to change beam shape.

2. The fixture of claim 1 wherein the reflecting surface is bowl shaped having a central axis.

3. The fixture of claim 1 wherein the light source is a high intensity discharge light source.

4. The fixture of claim 1 wherein the light source is elongated along an axis.

5. The fixture of claim 1 further comprising a primary reflector positioned at or near the light source and having a size that is on the order of the size of the light source.

6. The fixture of claim 4 wherein the axis of the light source is generally transverse to the direction of the central axis of the reflector.

7. The fixture of claim 1 wherein the first and second portions of the reflecting surface are generally equal halves.

8. The fixture of claim 7 wherein the halves are defined by a dividing plane along the central axis of the reflector.

9. The lighting fixture of claim 1 further comprising an adjustment mechanism operatively connected to the first and second portions, the adjustment mechanism having a first member connected to the first portion of the reflecting surface and a second member connected to the second portion of the reflecting surface, and an actuator that allows controlled movement of the first and second portions of the reflecting surface.

10. The fixture of claim 1 further comprising an enclosure around the reflecting surface and the light source.

11. The fixture of claim 10 wherein the enclosure is positioned on an adjustably positionable mount.

12. The fixture of claim 1 wherein the reflecting surface is moveable towards and away from the light source.

13. A lighting fixture having a bowl-shaped reflector and high intensity discharge light source positioned transverse to the aiming axis of the reflector, the improvement comprising:

the reflector split into two parts along a plane along the aiming axis, the two parts pivotably attached at or near the intersection of the aiming axis with the reflector.

14. The apparatus of claim 1 wherein the first and second portions of the reflecting surface are movable between a first position where the first and second portions are adjacent and produce a controlled concentrated high intensity light beam, and a second position where the first and second portions are pivoted away from one another and the beam pattern is elongated in one direction.

15. The fixture of claim 5 wherein the primary reflector is positioned on a side of the light source opposite the reflecting surface.

16. The fixture of claim 13 wherein the two parts are movable between a first position where the two parts are adjacent and produce a controlled concentrated beam pattern, and a second position where the two parts are pivoted away from one another and the beam pattern is elongated in one direction.

17. The fixture of claim 13 further comprising a primary reflector positioned at or near the light source and having a size that is on the order of the size of the light source and positioned generally opposite to the reflector.

18. A method of producing an adjustable controlled, concentrated high intensity light beam comprising:

positioning a reflecting surface operatively relative to a light source;

splitting the reflecting surface into two parts along a plane along the reflector's aiming axis;

adjusting the two parts in a pivotal manner at or near the intersection of the aiming axis with the reflector, the adjustment of the two parts causing a change in the elongation of beam pattern in one direction.

19. The method of claim 18 further comprising reflecting back into the reflector light issuing from the front of the light source.

* * * * *